US012715653B2

(12) United States Patent
Paschke

(10) Patent No.: US 12,715,653 B2
(45) Date of Patent: Aug. 25, 2026

(54) BEAR-RESISTANT CONTAINER

(71) Applicant: RECREATIONAL EQUIPMENT, INC., Sumner, WA (US)

(72) Inventor: Devin Paschke, Sumner, WA (US)

(73) Assignee: RECREATIONAL EQUIPMENT, INC., Sumner, WA (US)

( * ) Notice: Subject to any disclaimer, the term of this patent is extended or adjusted under 35 U.S.C. 154(b) by 86 days.

(21) Appl. No.: 18/984,861

(22) Filed: Dec. 17, 2024

(65) Prior Publication Data

US 2026/0167383 A1 Jun. 18, 2026

(51) Int. Cl.

| | |
|---|---|
| ***B65D 21/08*** | (2006.01) |
| ***B65D 21/02*** | (2006.01) |
| ***B65D 43/02*** | (2006.01) |
| ***B65D 43/26*** | (2006.01) |

(52) U.S. Cl.

CPC ..... *B65D 21/086* (2013.01); *B65D 21/0233* (2013.01); *B65D 43/0229* (2013.01); *B65D 43/26* (2013.01); *B65D 2543/00092* (2013.01); *B65D 2543/00342* (2013.01); *B65D 2543/00518* (2013.01); *B65D 2543/00546* (2013.01)

(58) Field of Classification Search

CPC ..... B65D 21/086; B65D 21/0233; B65D 43/0229; B65D 43/26; B65D 2543/00092; B65D 2543/00342; B65D 2543/00518; B65D 2543/00546; B65D 2543/0025; B65D 2543/00296; B65D 21/0228; B65D 21/08; B65D 21/083; A45F 3/00; A45F 2003/001; A45F 3/16; A45F 3/18; A45F 3/46

USPC ..... 220/4.04, 4.27, 8

See application file for complete search history.

(56) References Cited

U.S. PATENT DOCUMENTS

2007/0138176 A1* 6/2007 Gawlick ..... A47J 47/08 220/4.26

2012/0067881 A1* 3/2012 Thomas ..... B65D 21/086 220/8

(Continued)

FOREIGN PATENT DOCUMENTS

WO WO-2021074472 A1 * 4/2021 ..... B65D 25/44

OTHER PUBLICATIONS

English Machine Translation of WO-2021074472-A1 (Year: 2021).*

(Continued)

*Primary Examiner* — Laura E. Parker

(74) *Attorney, Agent, or Firm* — QUARLES & BRADY LLP

(57) ABSTRACT

A bear-resistant container can include a base, a sleeve, and a lid. The base can include a bottom wall and one or more side walls that extend from the bottom wall to a base open end, to define a base internal volume and support base internal threads. The sleeve can include one or more sleeve side walls that extend between open ends of the sleeve, to define a sleeve internal volume and support sleeve external threads at a first sleeve open end and sleeve internal threads at a second sleeve open end. The lid can include a top wall with one or more lid side walls that extend from the top wall to support lid external threads. The bear-resistant container can have a first height in a compressed configuration and a second height larger than the first height in an expanded configuration.

20 Claims, 20 Drawing Sheets

(56) References Cited

U.S. PATENT DOCUMENTS

| | | | | |
|---|---|---|---|---|
| 2012/0091131 | A1* | 4/2012 | Arjomand | B65D 7/22 220/4.01 |
| 2016/0114237 | A1* | 4/2016 | Garcia, Jr. | A63B 47/00 206/315.1 |
| 2019/0239691 | A1* | 8/2019 | Kirkham | A47J 41/0077 |

OTHER PUBLICATIONS

Backpacking Light, MYOG—Modular Bear Canister?, Retrieved from: https://backpackinglight.com/forums/topic/myog-modular-bear-canister/, Accessed on: Nov. 12, 2024, 9 pages.

Bearvault, BearVault BV475-Trek, https://bearvault.com/product/bv475/?srsltid=AfmBOorJOuJljv2w_WnkGemYD4ayGKEDklYIEO3bIZzFWq2LTDr4NFCY, Accessed on Nov. 12, 2024, 3 pages.

REI Co-Op, Garcia Bear-Resistant Container, Retrieved from: https://www.rei.com/product/624081/garcia-bear-resistant-container, Accessed on Nov. 12, 2024, 1 page.

Zac Rubenson Product Design & DEVELOPMENT, Bearier 700, Retrieved from: https://zacrubenson.com/camp4-outdoors-bearier-700, Accessed on Nov. 12, 2024, 7 pages.

* cited by examiner

BEAR-RESISTANT CONTAINER

CROSS-REFERENCE TO RELATED APPLICATIONS

Not applicable.

BACKGROUND

In some contexts, it may be useful to protect food or other items from bears or wildlife.

SUMMARY

Embodiments of the invention can provide a bear-resistant container. The bear-resistant container can include a base. The base can include a bottom wall and one or more base side walls that extend from the bottom wall to a base open end, to define a base internal volume and support base internal threads. The bear-resistant container can include a sleeve. The sleeve can include one or more sleeve side walls that extend between open ends of the sleeve, to define a sleeve internal volume and support sleeve external threads at a first sleeve open end and sleeve internal threads at a second sleeve open end. The bear-resistant container can include a lid. The lid can include a top wall and one or more lid side walls that extend from the top wall to support lid external threads. The bear-resistant container can be in a compressed configuration having a first height. The base can be nested within the sleeve internal volume. The lid external threads can be engaged with the base internal threads to secure the lid to the base and close the base internal volume at the base open end. The bear-resistant container can be in an expanded configuration having a second height larger than the first height. The base internal threads can be engaged with the sleeve external threads to secure the base to the sleeve, with the base internal volume open to the sleeve internal volume at the first sleeve open end. The lid external threads can be engaged with the sleeve internal threads to secure the lid to the sleeve and close the sleeve internal volume at the second sleeve open end.

Some embodiments provide a method of configuring a bear-resistant container. The method can include filing material into a base internal volume that is defined by a bottom wall of a base of the bear-resistant container and by one or more side walls extending from the bottom wall to a base open end. The method can include selectively closing an interior volume of the bear-resistant container in a compressed configuration or an expanded configuration. Wherein, in the compressed configuration, the base can be nested within a sleeve internal volume of a sleeve. The sleeve internal volume can be defined by one or more sleeve side walls that extend between a first sleeve end and a second sleeve end. In the compressed configuration, the external threads of a lid can be engaged with internal threads of the base to secure the lid to the base and close the base internal volume. Wherein, in the expanded configuration, the internal threads of the base can be engaged with external threads of the sleeve to secure the base to the sleeve, with the base internal volume open to the sleeve internal volume at the first sleeve open end. In the expanded configuration, the external threads of the lid can be engaged with internal threads of the sleeve to secure the lid to the sleeve and close the sleeve internal volume at the second sleeve open end.

Some embodiments provide a bear-resistant container. The bear-resistant container can include a base. The base can include an integral base body that defines a base internal volume and a base open end with base threads. The bear-resistant container can include a sleeve. The sleeve can include an integral sleeve body that can define a sleeve internal volume, a first sleeve open end with first sleeve threads, and a second sleeve open end with second sleeve threads. The bear-resistant container can include a lid. The lid can include an integral lid body that can include lid threads. The bear-resistant container can be selectively configurable in a compressed configuration and an expanded configuration. In the compressed configuration, the base can be received into the sleeve internal volume and the lid threads engage the base threads to close the base open end. In the expanded configuration, the base threads can engage the first sleeve threads to secure the base to the sleeve, with the base internal volume open to the sleeve internal volume at the first sleeve open end, and the lid threads engage the second sleeve threads to close the second sleeve open end.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Figure 1:
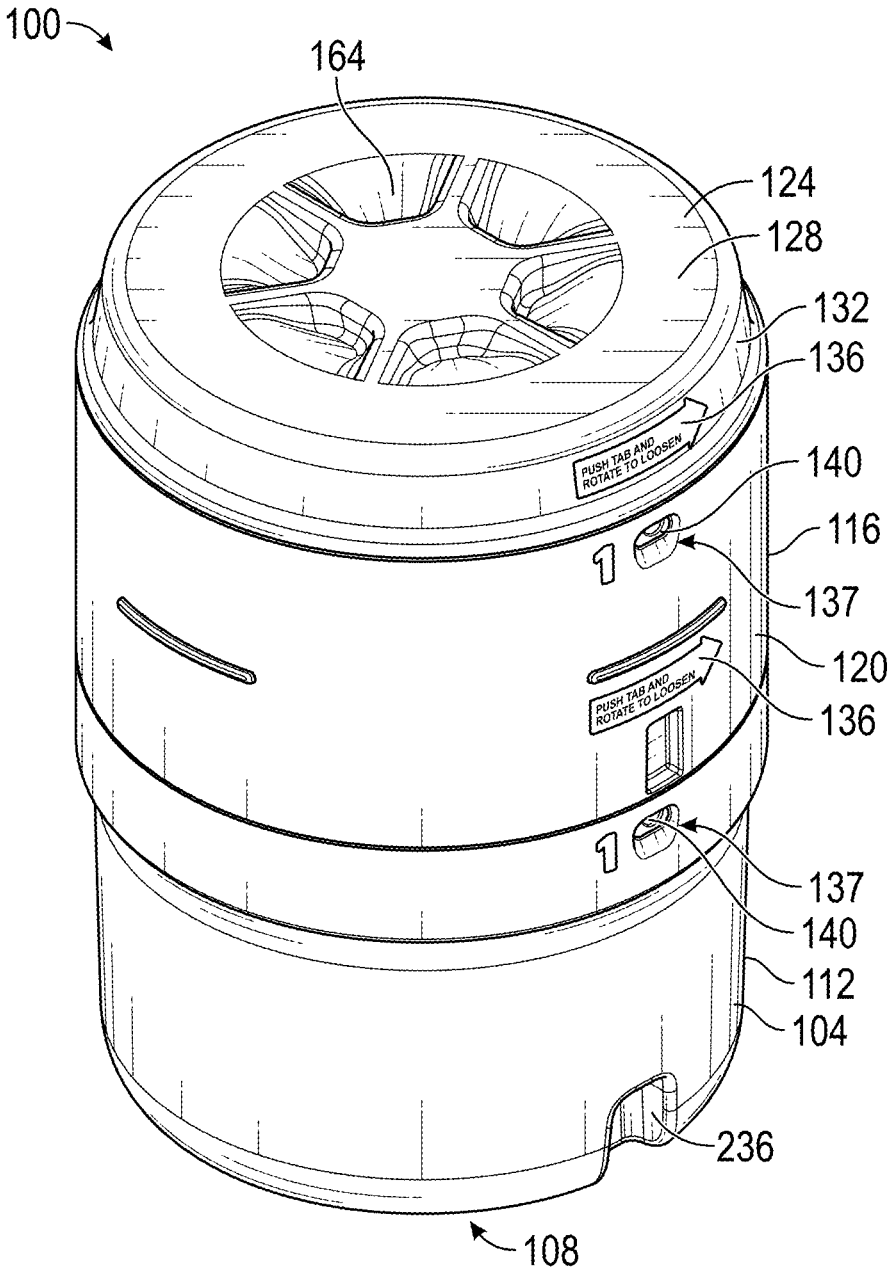
FIG. 1 is an axonometric view of a bear-resistant container, according to an embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

The discussion herein is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Bear-resistant containers can be useful to protect food or other items from bears or other wildlife. However, conventional bear-resistant containers can be overly large and unwieldy for some uses, particularly when designed with capacity to store food for multiple people over an extended period of time. For example, space initially required for food may quickly empty as a trip progresses, but the container around that empty space may still occupy considerable volume (e.g., to be carried in a trekking pack).

Some conventional bear-resistant containers may also suffer avoidable damage or defeat in the field. For example, the design of seams and other contours on conventional containers may render the containers susceptible to defeat by bears' varied and creative modes of engagement. For example, bears may variously try to access food in containers through the use of teeth or claws to puncture or to pry, or through the concentration of body-weight on vulnerable points of a container's structure.

Examples of the present disclosure provide containers that can address these and other issues. Some examples can provide a bear-resistant container that can be reduced in overall size in a compressed configuration, while still providing a relatively large storage capacity in an expanded configuration. In an example modular threaded arrangement, a container lid can be selectively secured to a container base or to a first end of a sleeve (e.g., with a threaded engagement). Further, the second end of the container sleeve can be selectively secured to the container base (e.g., with a threaded engagement, in lieu of the container lid). Accordingly, with particular arrangements of the lid, the base, and the sleeve, the overall size and storage capacity of the container can be made selectively larger or smaller. Further, in some cases, a base can nest within a sleeve (e.g., when the base is separately closed by a lid), to further reduce an overall spatial footprint of the components.

Some examples can additionally (or alternatively) provide improved geometry to resist damage by wildlife. For example, overlapping flanges of adjacent components can provide improved resistance against damage due to transverse compression (e.g., due to direct application of a bear's weight). Such flanges can also, for example, reduce access for leveraged prying or puncture force with teeth or claws, to further protect against defeat at threaded or other seams.

As another example, features on a lid or other portion of container can be contoured to reduce the potential leverage of localized forces on the container (e.g., forces from biting). For example, improved relative angular orientations and associated convex areas protect against larger animals applying leveraged force at vulnerable locations (e.g., via bites across container corners).

In various examples, these or other benefits can be provided alone, or in combination, with enhanced effects. For example, particular ease of operation and in-field durability may be achieved through the use of threaded overlapping flanges, as further detailed below.

Some examples can further provide improved unlocking methods for a container, to access an interior volume of the container. For example, detents or other components of a set of latching systems can be arranged to be engaged in a required sequence to release a lid (or other component) from a container. Such an arrangement may result in a latching arrangement overall that is easily operable by humans, but difficult to accidentally (or otherwise) defeat by biting or clawing engagements.

Generally, a modular bear-resistant (or other) container can include a base, a sleeve, and a lid. As noted above, for example, these modular components can be selectively secured to provide a larger-sized or smaller-sized container. Referring to FIG. 1, for example, a bear-resistant container 100 includes a base 104, as sleeve 116, and a lid 124. Generally, each of the base 104, the sleeve 116, and the lid 124 can be integrally formed (e.g., with polycarbonate, acrylonitrile butadiene styrene (ABS), carbon fiber, or other composite materials), although other manufacturing approaches are possible.

The illustrated three-component configuration may provide particular desirable arrangements for a wide range of expeditions. However, other configurations are possible. For example, one or more additional sleeves can be provided in some cases, with the sleeves selectively securable to each other or to the base or lid (as generally described below), to provide multiple expanded configurations of increasing capacity.

Figure 9:
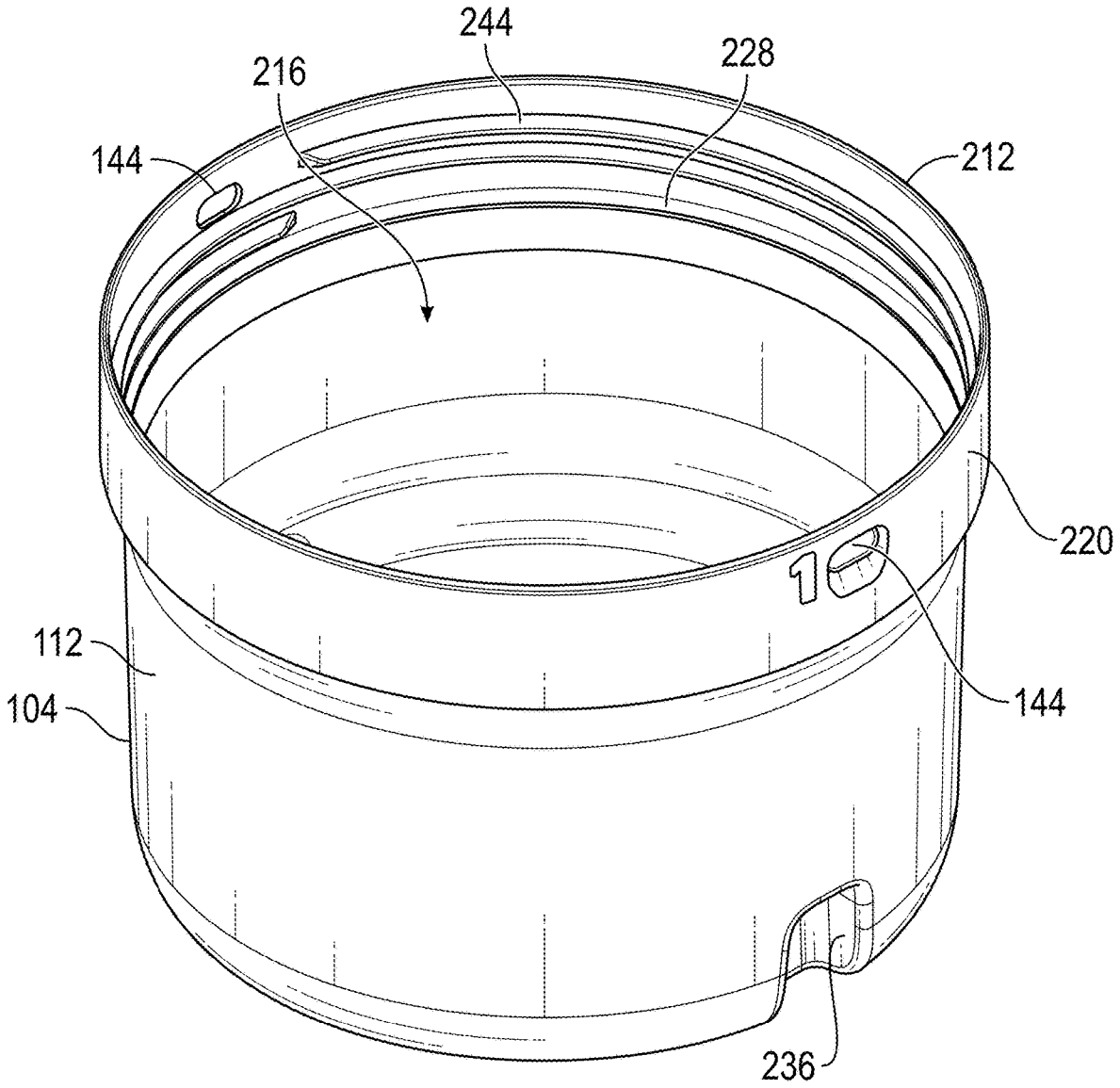
FIG. 9 is an axonometric view of a base of the bear-resistant container of FIG. 1.
Figure 10:
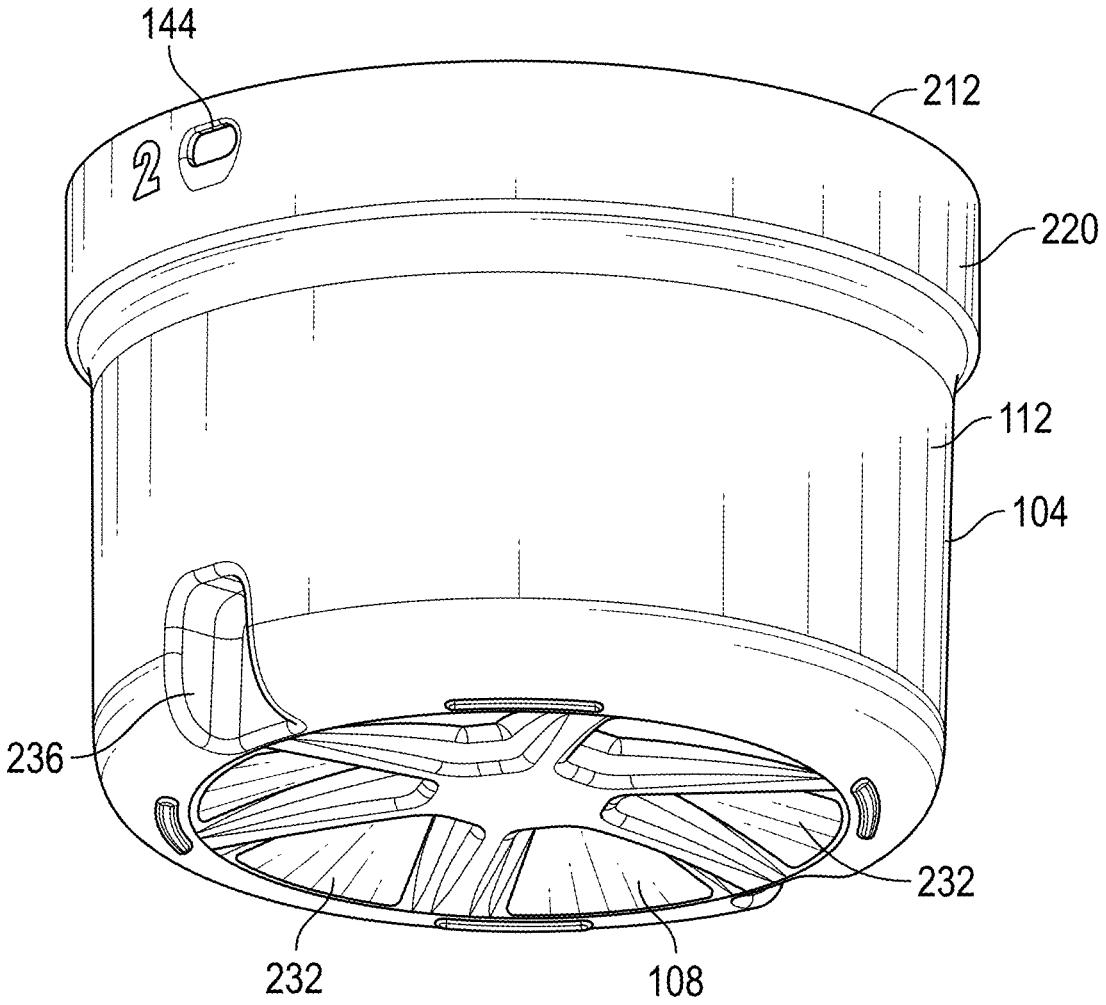
FIG. 10 is another axonometric view of the base of FIG. 9.
Figure 11:
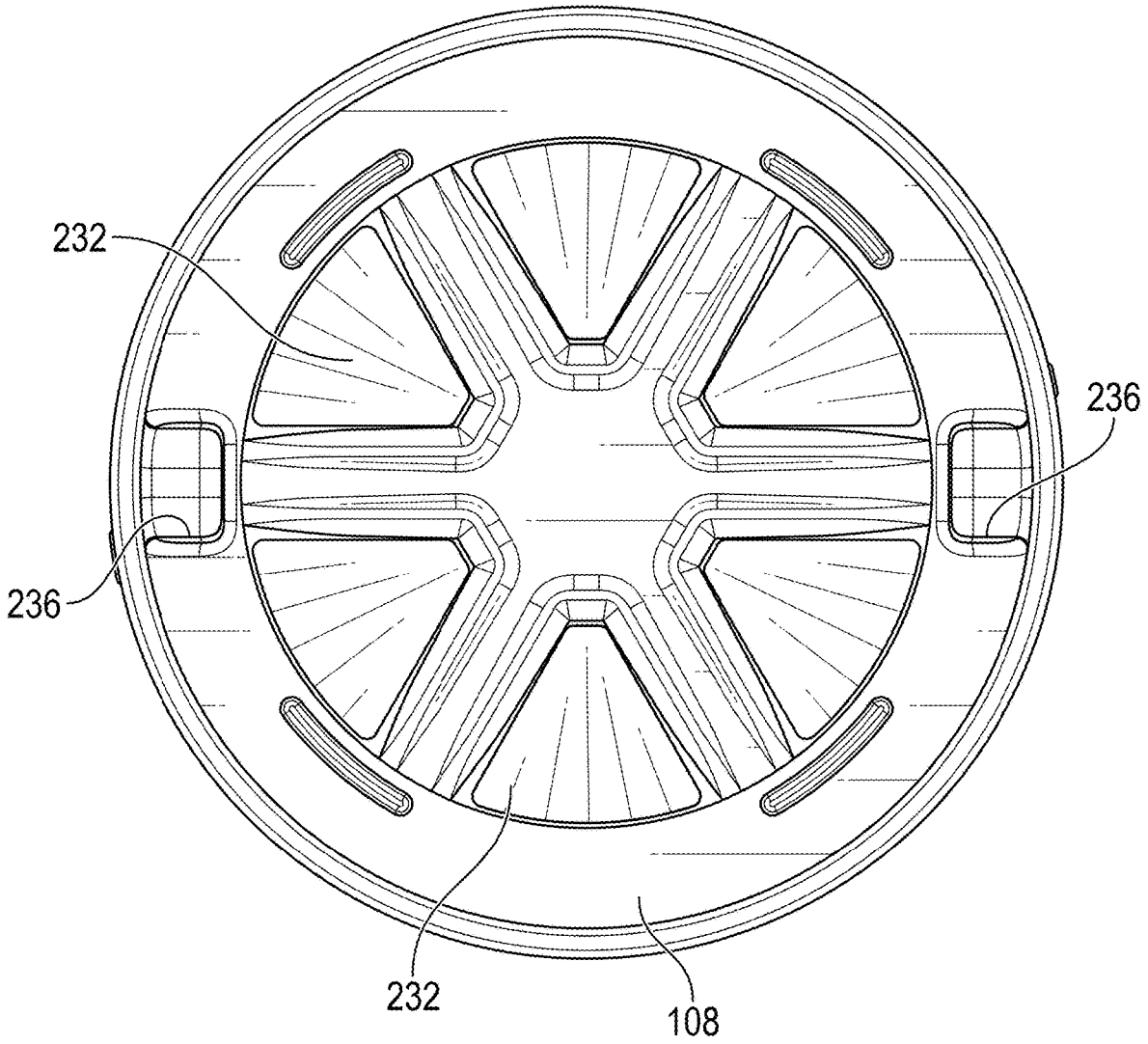
FIG. 11 is a bottom view of the base of FIG. 9.

As also shown in FIGS. 9-11, the base 104 includes a bottom wall 108 and a base side wall 112. In particular, the base side wall 112 is cylindrical, as shown. Generally, however, the base 104 can include one or more base side walls (e.g., with a hexagonal or another polygonal perimeter, etc.).

Figure 7:
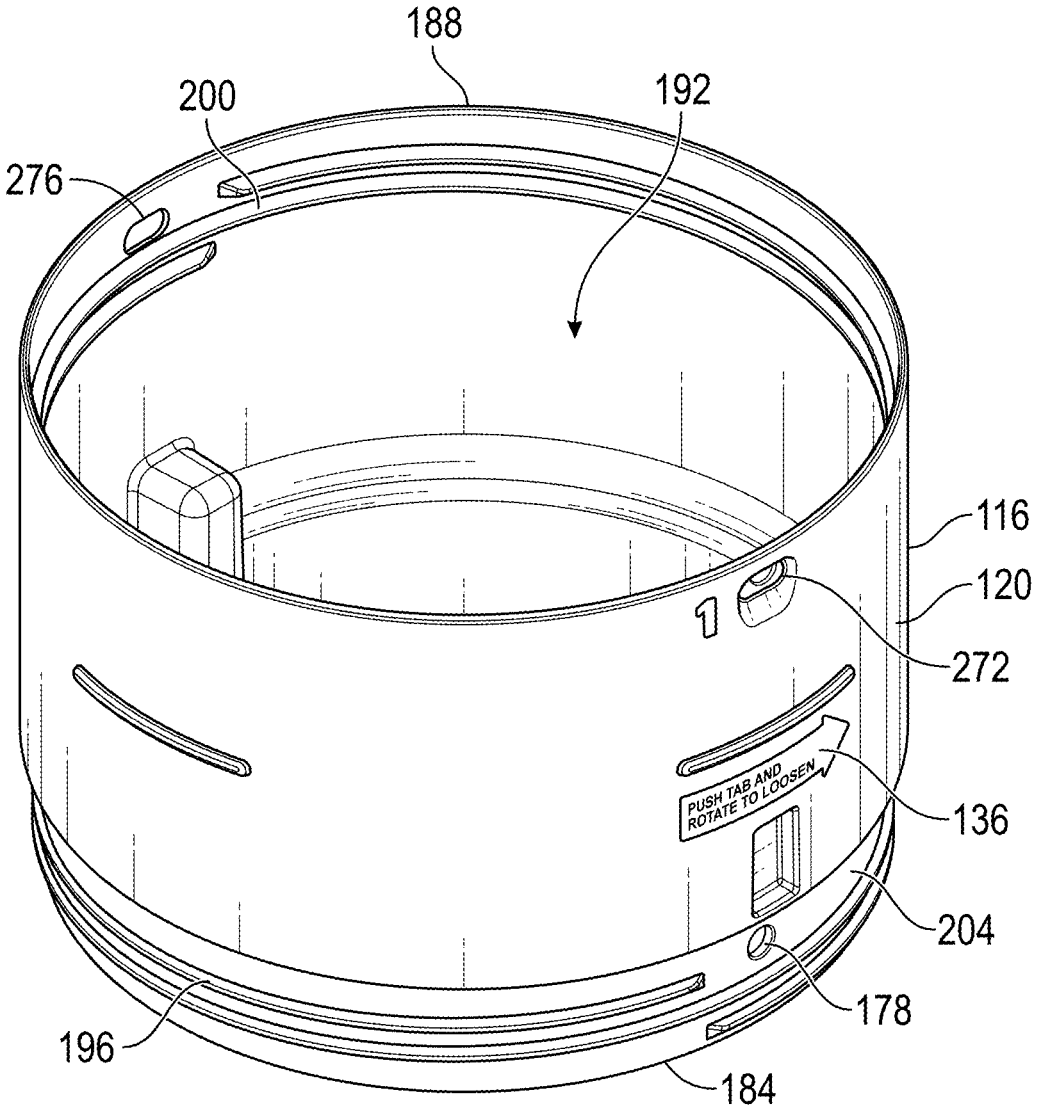
FIG. 7 is an axonometric view of a sleeve of the bear-resistant container of FIG. 1.
Figure 8:
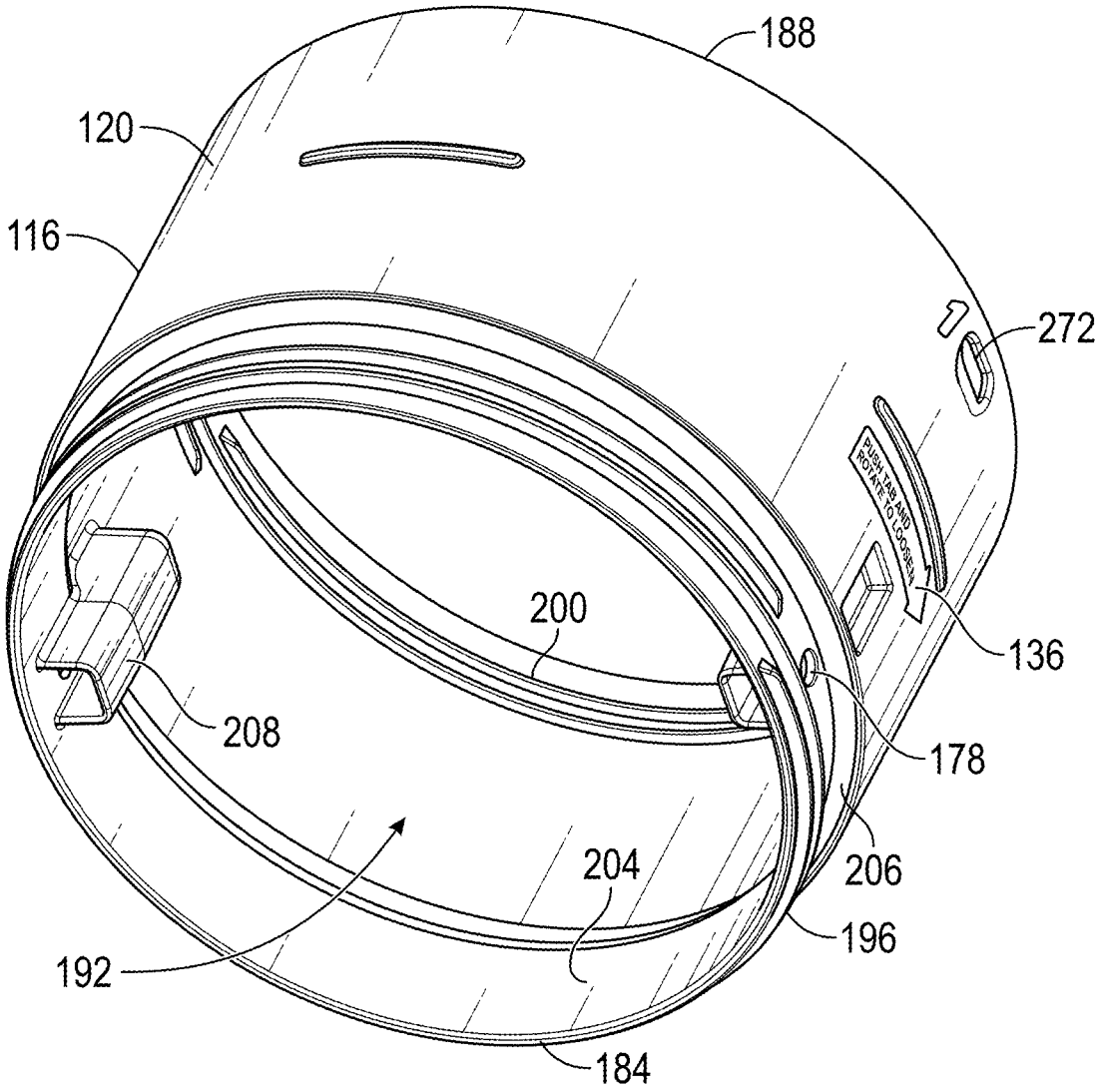
FIG. 8 is another axonometric view of the sleeve of FIG. 7.

Still referring to FIG. 1, as well as FIGS. 7 and 8, the sleeve 116 can include a sleeve side wall 120. Similarly to the base 104, the sleeve 116 can generally include one or more sleeve side walls (e.g., with a hexagonal or another polygonal perimeter, etc.). In particular, the sleeve side wall 120 is cylindrical, as shown.

As shown in FIGS. 1 and 4-6, the lid 124 can include a top wall 128 and a lid side wall 132. Similarly to the base 104 and the sleeve 116, the lid 124 can generally include one or more lid side walls (e.g., with a hexagonal or another polygonal perimeter, etc.). In particular, however, the lid side wall 132 is cylindrical, as shown.

In some cases, one or more latch systems can be provided. For example, multiple latch systems 137 can be provided, as partially shown in FIG. 1, to selectively secure the lid 124, the sleeve 116, and the base 104 together- and to selectively release one or more of these components from the other(s). In the illustrated example, as further discussed below, the latch systems 137 include a plurality of detents that are received within corresponding slots (or other openings). The detents can be configured to be sequentially moved out of the slots to allow the bear-resistant container 100 to be opened (e.g., via unscrewing of the lid 124 or the sleeve 116). Further, various associated indica 136 can be provided, as appropriate (e.g., to guide a user to use a latch system 137).

With reference again to FIGS. 1 through 3, a user can selectively change the bear-resistant container 100, between compressed and expanded configurations, to change both the internal capacity and external (three-dimensional) footprint of the container 100. As shown in FIG. 1, an example expanded configuration includes the lid 124 attached to an end of the sleeve 116, and with an opposite end of the sleeve 116 attached to the base 104. Thus, a relatively large internal capacity can be provided.

Figure 2:
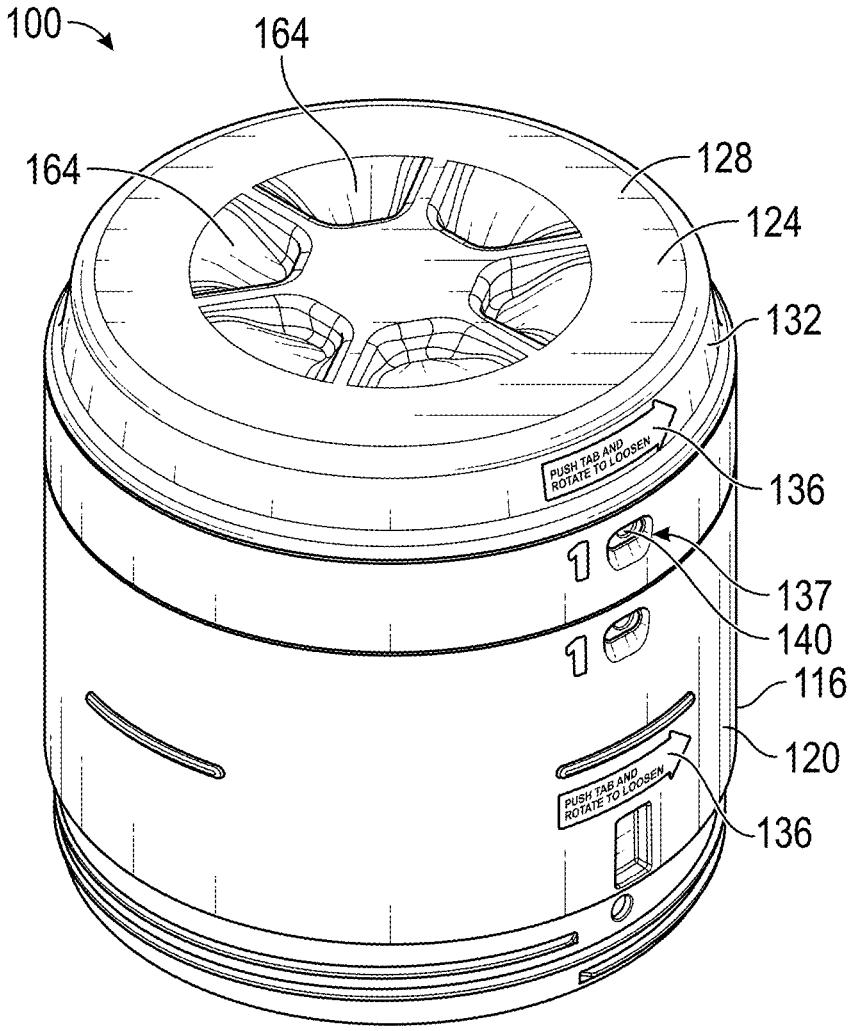
FIG. 2 is an axonometric view of the bear-resistant container of FIG. 1 in a collapsed configuration.
Figure 3:
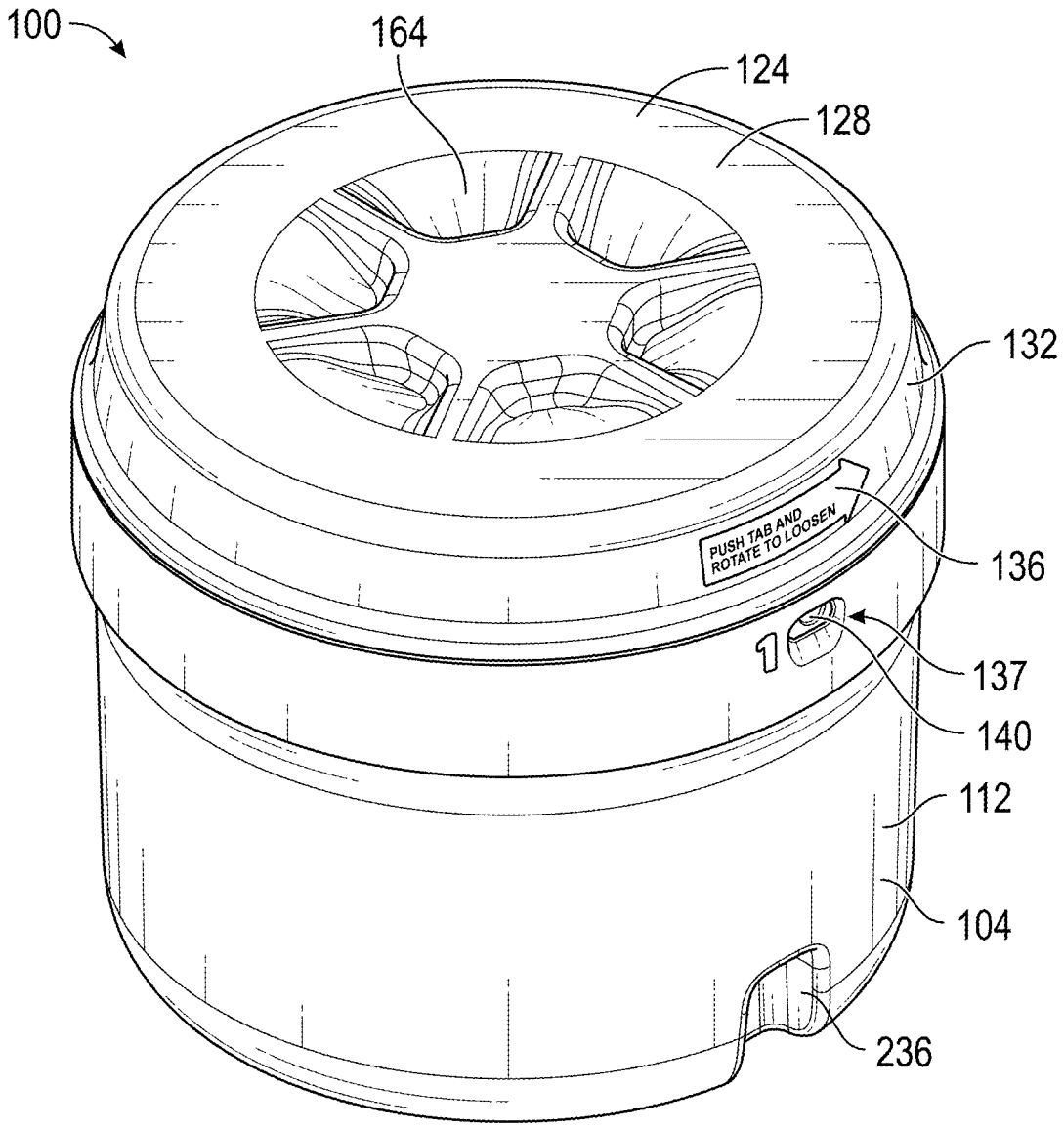
FIG. 3 is an axonometric view of the bear-resistant container of FIG. 1 in another collapsed configuration.

Referring to FIGS. 2 and 3, the example compressed configurations include the lid 124 attached to the base 104, without the sleeve 116 intervening therebetween. Further, in some cases, the base 104 can be nested into the sleeve 116, as shown in FIG. 2. In particular, the example compressed configuration of FIG. 2 can allow the bear-resistant container 100 to have a smaller spatial footprint and a reduced internal space while still being packable along with the sleeve 116. Thus, the bear-resistant container 100 can provide substantial starting capacity while being more easily packable later in a trip, or can be generally customizable for particular trip durations or participants (e.g., configured in the compressed configuration for shorter trip durations, and configured in the expanded configuration for longer trip durations).

Examples of the containers disclosed herein can additionally (or alternatively) include structural improvements for enhanced resistance to damage by wildlife. For example, some modular containers can include overlapped material or relatively small gaps at seams between modular components, to provide structural support against varied types of animal engagement (e.g., as discussed further below, with regard to engagement between the lid 124 and the sleeve 116, the lid 124 and the base 104, and the sleeve 116 and the base 104). Similarly, threaded engagement (e.g., with overlapping flanges) or favorable angles and convexity at container corners can provide both improved operability and improved resistance to animal engagement.

Figure 4:
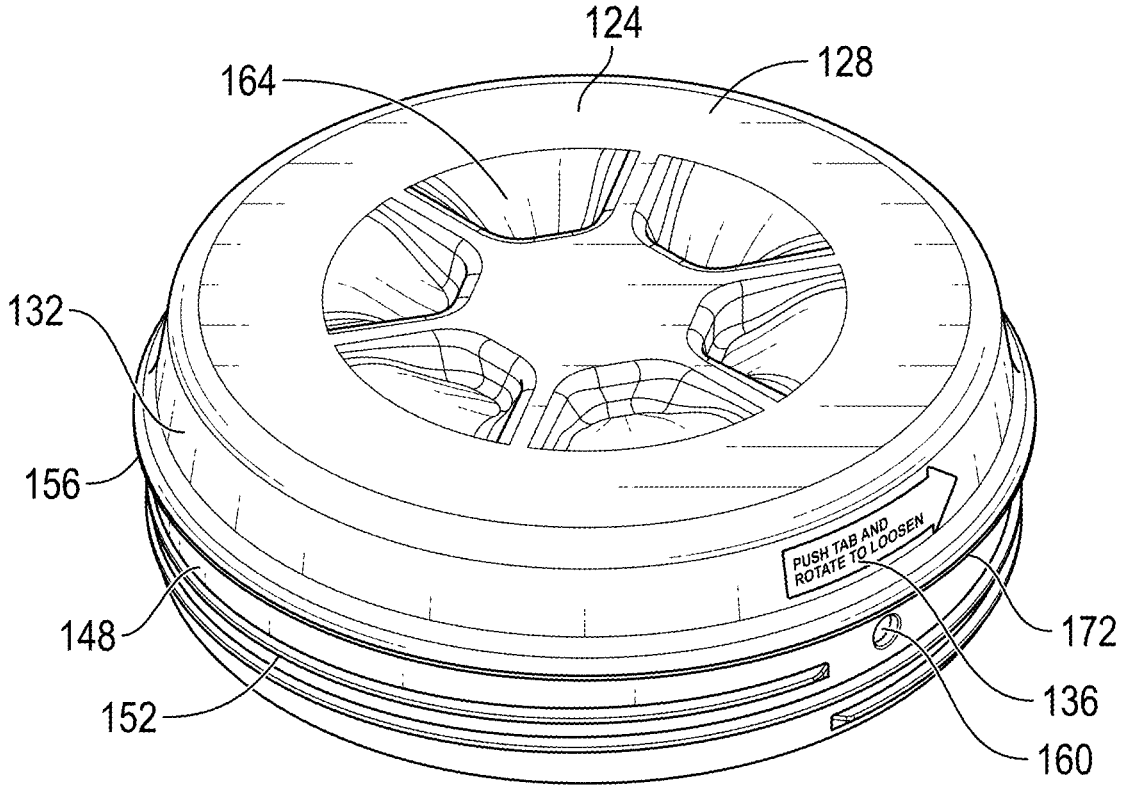
FIG. 4 is an axonometric view of a lid of the bear-resistant container of FIG. 1.

To provide a threaded engagement with favorable overlap, one or more side walls of a lid can extend from a top wall to define a flange that supports external threads. Referring to FIG. 4, for example, the lid 124 includes the lid side wall 132 that extends from the top wall 128. As shown, and further detailed below, the lid 124 is cylindrical, but with a local radius that varies axially along the lid 124. In other examples, other profiles are possible, including with different contours or different scaling. In some cases, as also noted above, the lid 124 can be formed as an integral lid body.

Figure 6:
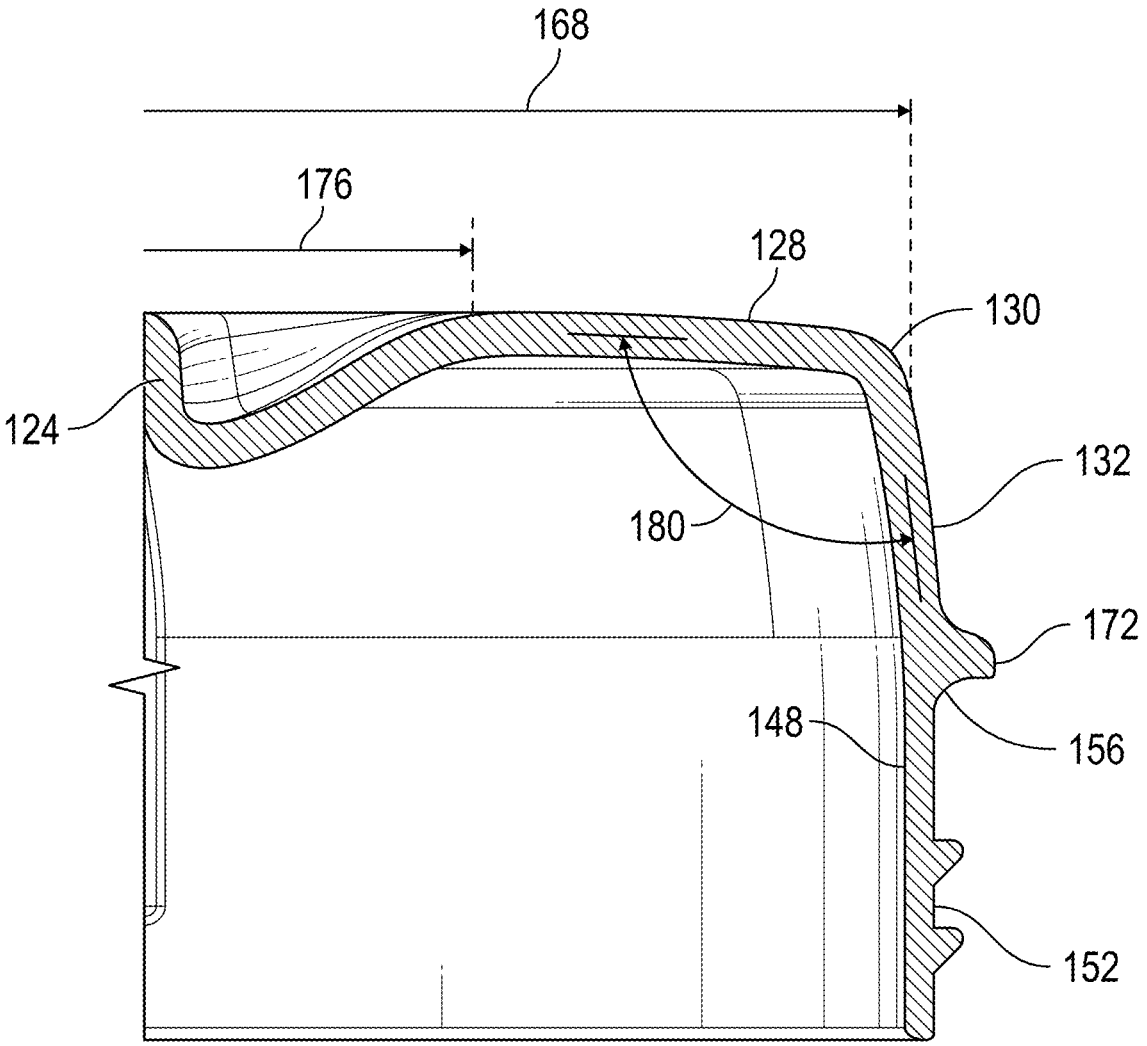
FIG. 6 is a cross-sectional partial view of the lid of FIG. 5 taken along VI-VI.

As shown in FIGS. 4 and 6, the lid side wall 132 extends from the top wall 128 to define a lid end flange 148 that supports (e.g., integrally includes) lid external threads 152. In particular, the lid end flange 148 supports the lid external threads 152 with an inward radial offset relative to a lid shoulder 156 that is defined by a peripheral lip 172 of the lid 124. Correspondingly, as shown in FIG. 6, the lid shoulder 156 protrudes radially outwardly relative to the lid end flange 148. As shown in FIG. 4, and further detailed below, the lid end flange 148 can also include one or more detent openings 160.

In some cases, contours on a lid can help with easier handling by users as well as improve resilience to animal engagement. For example, the lid 124 includes contoured grip indents 164 to help a user to screw the lid 124 onto or off of the sleeve 116 or the base 104, and thereby close or open the bear-resistant container 100.

Figure 5:
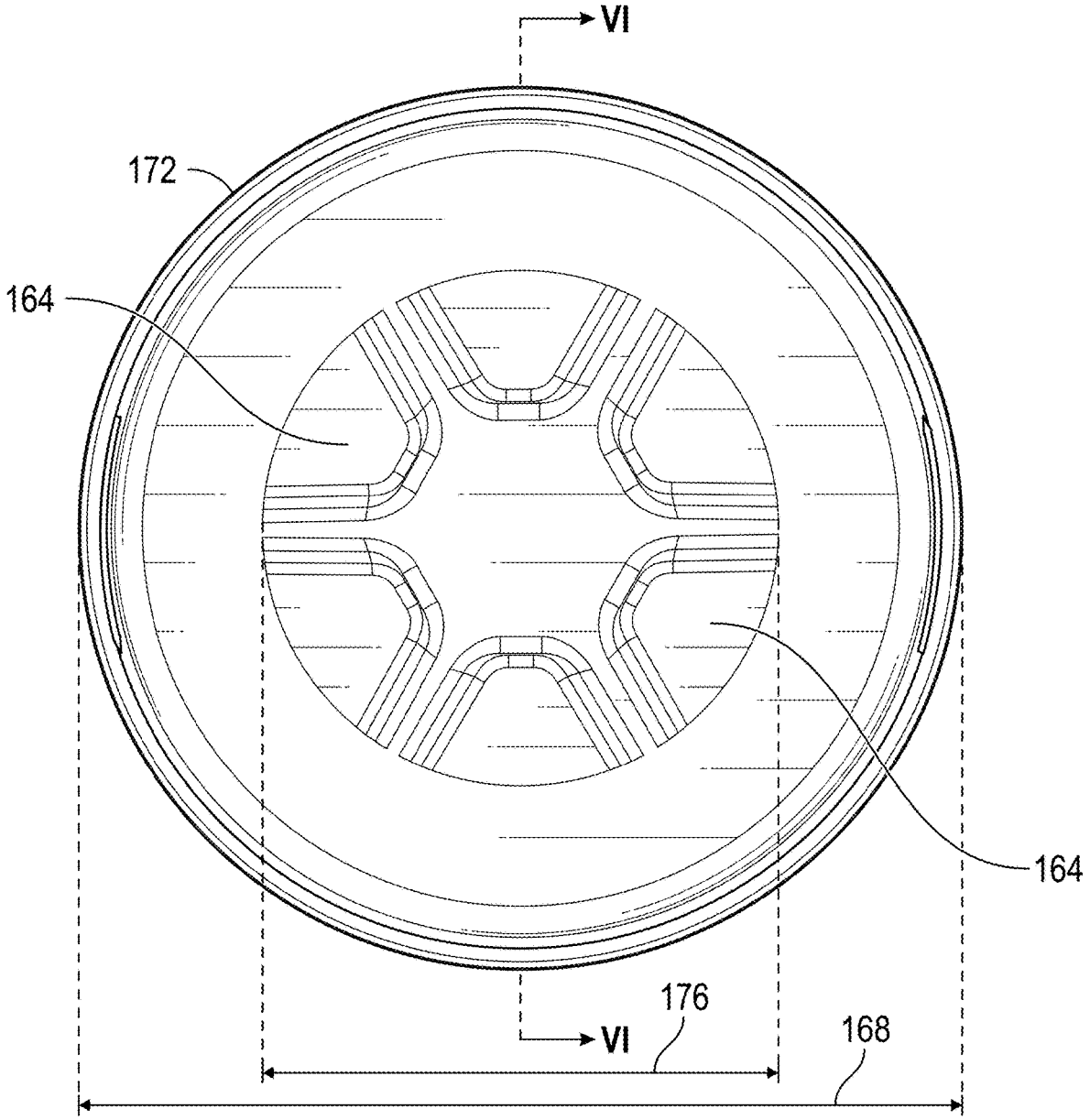
FIG. 5 is a top view of the lid of FIG. 4.

To balance ease of engagement by a user with resistance to defeat by animals, it may be useful to arrange grip intents to be spaced radially inwardly by sufficient distance from an outer width of the lid (or other engagement point). Referring to FIG. 5, for example, the lid 124 defines a maximum outer width 168 at the peripheral lip 172 of the lid. To reduce ability of animals to use the contours of the lid 124 for leverage, radially outer edges of the grip indents 164—as indicated by a grip indent width 176—can be spaced radially inwardly from the maximum outer width 168 by at least 15% of the maximum outer width 168.

Particular contours at bends between side and top walls of a lid (or other component) can also help to reduce leverage for animal bites and other adverse engagements. For example, referring again to FIG. 6, the top wall 128 extends away from a bend 130 between the top wall 128 and the lid side wall 132 with a concave profile, relative to the internal volume (i.e., with a convex profile, relative to the exterior of the bear-resistant container 100). Additionally, the top wall 128 extends from the bend 130 at an angle 180, relative to the lid side wall 132, that is greater than 90 degrees. In other words, the lid top wall 128 angles upwards from the lid side wall 132, in the orientation shown. These concave and obtuse aspects of the lid 124 at the bend 130, both individually and collectively, can help to reduce leverage for a bear or other animal to puncture or pry at the bear-resistant container 100 (e.g., via toothed engagement at the indents 164).

As noted above, the sleeve 116 can be selectively used to extend the capacity of the container 100. Referring to FIGS. 7 and 8, in particular, the sleeve 116 includes a sleeve side wall 120 that extends between a first sleeve open end 184 and a second sleeve open end 188 to define a sleeve internal volume 192. As with the lid 124, the sleeve 120 is cylindrical, but with a local radius that varies axially along the sleeve 120. In other examples, however, other profiles are possible, including with different contours or different scaling. In some cases, as also noted above, the sleeve 116 can be formed as an integral sleeve body.

In the illustrated example, the sleeve 116 is configured for threaded engagement with, selectively, the lid 124 or with the base 104. Accordingly, for example, the sleeve side wall 120 supports sleeve external threads 196 at the first sleeve open end 184, and the sleeve side wall 120 supports sleeve internal threads 200 at the second sleeve open end 188. In particular, the sleeve 116 includes a sleeve end flange 204 that is offset radially inwardly at the first sleeve open end 184 to support the sleeve external threads 196 and correspondingly define a sleeve shoulder 206 (see also FIG. 13A). As shown in FIG. 7, and further discussed below, the sleeve 116 also includes one or more detent openings 178 (similar to the opening(s) 160, see FIG. 4) and detent slots 272, 276.

Referring to FIGS. 9-11, the base 104 includes the base side wall 112, extending from the bottom wall 108 to a base open end 212 to define a base internal volume 216. In some cases, as also noted above, the base 104 can be formed as an integral base body. As with the lid 124 and the sleeve 120, the base 104 is cylindrical, but with a local radius that varies axially along the base 104. In other examples, other profiles are possible, including with different contours or different scaling.

The base side wall 112 further includes a base end flange 220 that is offset radially outwardly at the base open end 212 to support base internal threads 224. Thus, for example, the base end flange 220 can define a base shoulder 228. The base end flange 220 can also include slots 144 to receive the detents 140 (see also, e.g., FIG. 1).

With reference to FIG. 10, the bottom wall 108 can include indents 232 to provide improved overall stability and strength for the base 104 (e.g., with similar spacing or contoured profiles as discussed above relative to the indents 164 of the lid 124). In the illustrated example, the base 104 also includes an exterior recess 236 that interrupts the bottom wall 108 and the cylindrical profile of the side wall 112.

Figure 12:
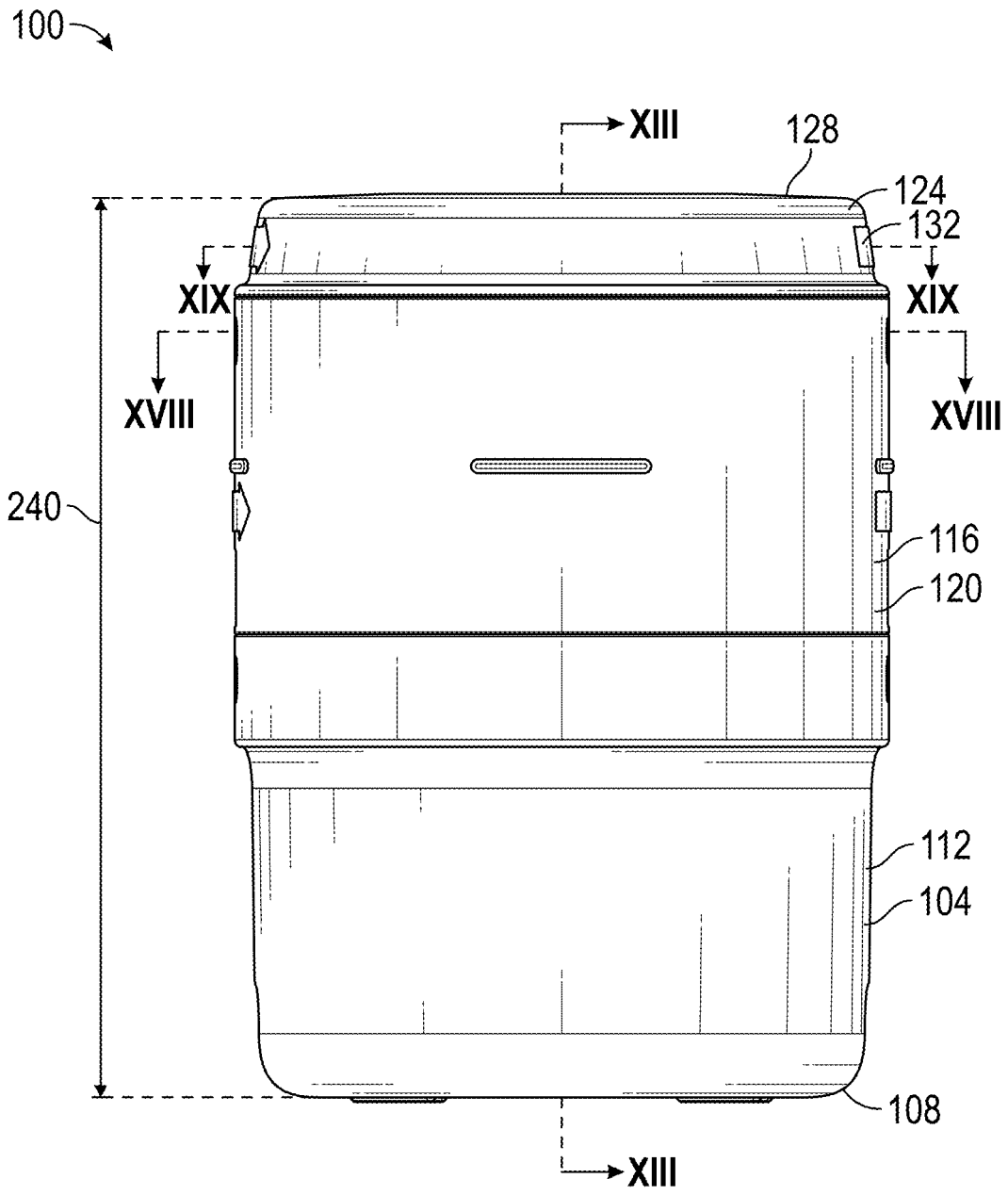
FIG. 12 is a front view of the bear-resistant container of FIG. 1.
Figure 16:
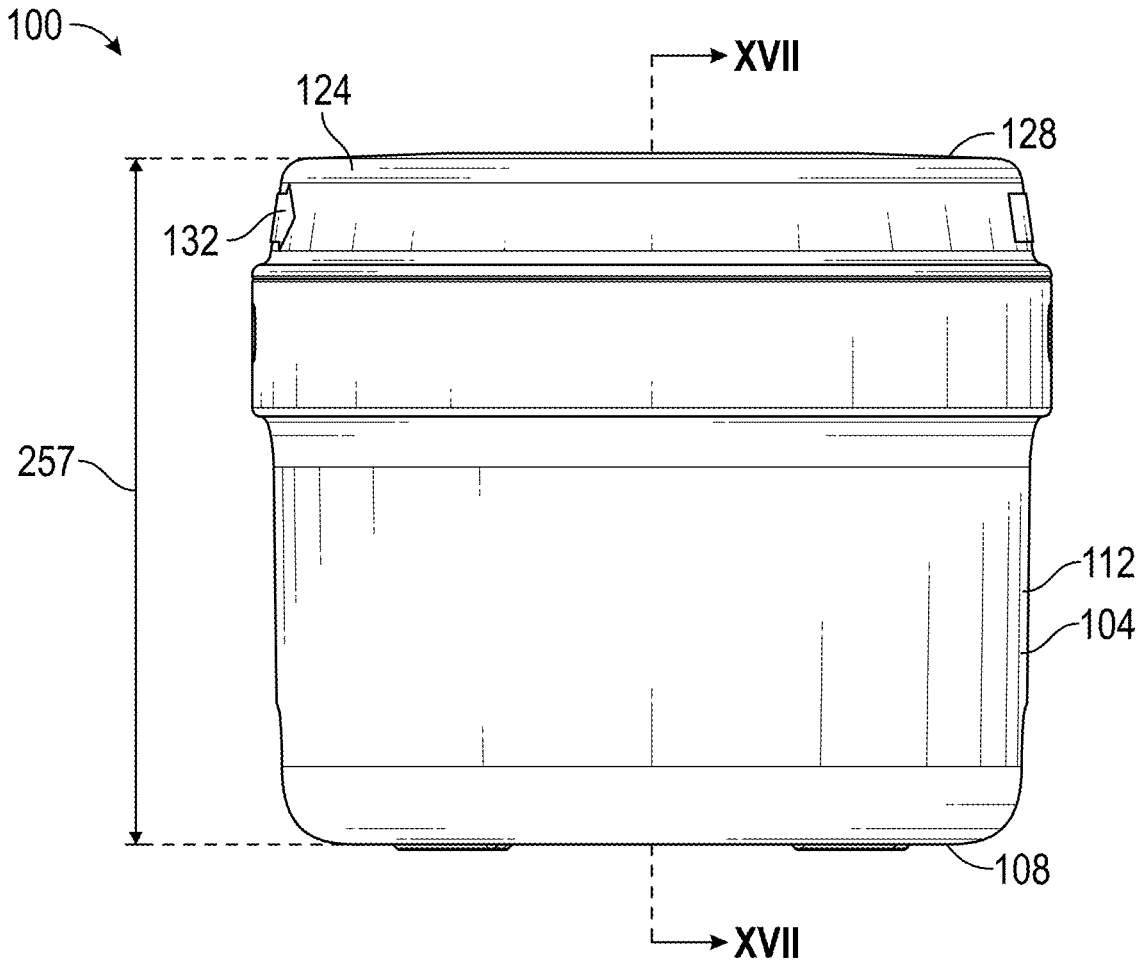
FIG. 16 is a front view of the bear-resistant container of FIG. 3.

Generally, a bear-resistant container can have a larger height in an expanded configuration than in a compressed configuration. For example, referring to FIG. 12, the illustrated expanded configuration has a first height 240 that may be between 12 inches and 14 inches, inclusive, or within various other ranges (e.g., from 10 inches to 18 inches, inclusive). In contrast, referring to FIG. 14, a compressed configuration that includes the sleeve 116 has a second height 244 that may be between 8 inches and 10 inches, inclusive, or within various other ranges (e.g., from 6 inches to 14 inches, inclusive). In some cases, the second height 244 is about 70% of the first height 240, or less. In a compressed configuration without the sleeve 116, as shown in the example of FIG. 16, a height 257 of the container 100 may be between 7 inches and 9 inches, inclusive, or within various other ranges (e.g., from 5 inches to 13 inches, inclusive). In some cases, the height 257 can be about 65% of the first height 240, or less.

Figure 13A:
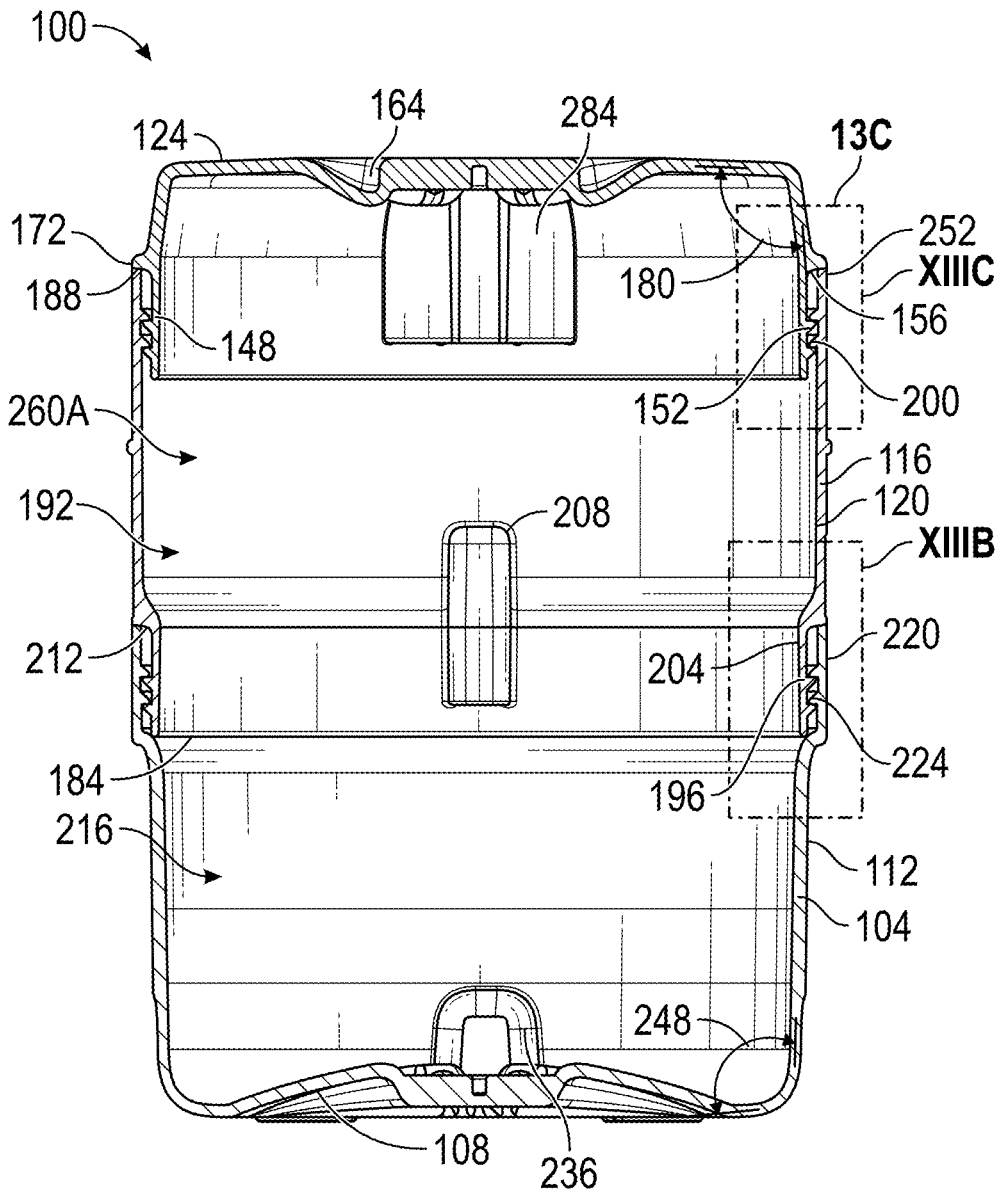
FIG. 13A is a cross-sectional view of the bear-resistant container of FIG. 12 taken along XIII-XIII.

In an expanded configuration, a base and a sleeve of a bear-resistant container can be engaged by threads to secure the base to a corresponding end of the sleeve. Referring to FIG. 13A, for example, the base internal threads 224 are engaged with the sleeve external threads 196 (e.g., first sleeve threads) to secure the base 104 to the sleeve 116. The base internal volume 216 can thus be open to the sleeve internal volume 192 at the first sleeve open end 184 to collectively provide an expanded interior volume for the container 100.

Further, as shown in FIG. 13A, the base end flange 220 axially overlaps with the sleeve end flange 204 at and beyond the threaded engagement. In other words, the overlapping engagement of the base end flange 220 and the sleeve end flange 204 extends past the sleeve external threads 196 and the base internal threads 224, which can help to reinforce the (threaded) joint between the sleeve 116 and the base 104. For example, as shown in FIG. 13B, the sleeve end 184 can extend past the threads 196, 224 to seat on the shoulder 228 or the base end 212 can extend past the threads 196, 224 seat on the shoulder 206. In some examples, accordingly, there can be a flush alignment of the base 104 and the sleeve 116 at the external seam (e.g., at the base end 212, as shown in FIG. 13B), to avoid giving an animal a leverage point to pry apart the threaded engagement. Additionally, axial overlap at joints (e.g., at threaded joints, as shown) can correspondingly increase resistance to failure from lateral loading, including for radial loading, by an animal's weight, with the container 100 resting on the base or sleeve side walls 112, 120).

Although a range of overlap distances are possible, some configurations may more beneficially balance strength, manufacturability, and ease of operation. For example, as illustrated, the flange 220 may extend past the threaded engagement (toward the lid 124) by between about 35% and about 50% of a total axial length of the flange 220, inclusive, or by between about 60% and about 80% of an axial extend of the threads 224, inclusive. As also discussed below, similarly beneficial engagement and overlap can also be provided with other overlapping flanges of the container 100, including with the same relative dimensions noted above.

In an expanded configuration, a lid and a sleeve can also be secured together by threads (e.g., with the lid at an opposite end of the sleeve from the base). Continuing with FIG. 13A, for example, the lid external threads 152 are engaged with the sleeve internal threads 200 (e.g., second sleeve threads) to secure the lid 124 to the sleeve 116 and close the sleeve internal volume 192 at the second sleeve open end 188. As similarly discussed above relative to the threaded engagement between the base 104 and the sleeve 116, and relative to the lid 124 and the base 104 below, overlap between the lid end flange 148 and the sleeve 116 can provide improved engagement and security. Thus, for example, side wall 120 of the sleeve 116 may extend past the threaded engagement (toward the lip 172 and the shoulder 156) by between about 35% and about 50% of a total axial length of the flange 148, inclusive, or by between about 60% and about 80% of an axial extend of the threads 152, inclusive.

To provide further protection against unwanted leverage, as mentioned above and also shown in FIG. 13A, the top wall 128 extends inwardly from the lid side wall 132 at the angle 180 of greater than 90 degrees. Similarly, the bottom wall 108 of the base 104 extends inwardly from the base side wall 112 of the base 104 at an angle 248 greater than 90 degrees. As similarly discussed above for the lid 124, this arrangement of the angle 248 can help to reduce overall leverage for biting or other animal engagement-particularly given the large spacing between the bottom wall 108 and the seam at the base end 212.

As also shown in FIG. 13A, the lid end flange 148 nests within the second sleeve open end 188, to overlap with the side wall 120. This particular relative arrangement can avoid giving an animal access to the free edge of the flange 148, which might otherwise provide a leverage point to remove the lid 124 via a bite or other engagement that pries the lid end flange 148 outwardly (e.g., with simultaneous biting engagement on the top wall 128 and the lid end flange 148). In contrast, engagement with the (relatively) more exposed sleeve open end 188 may tend to provide little useful leverage, because the sleeve side wall 120 extends relatively smoothly in the corresponding prying direction (i.e., in the direction away from the peripheral lip 172 of the lid 124).

Figure 13C:
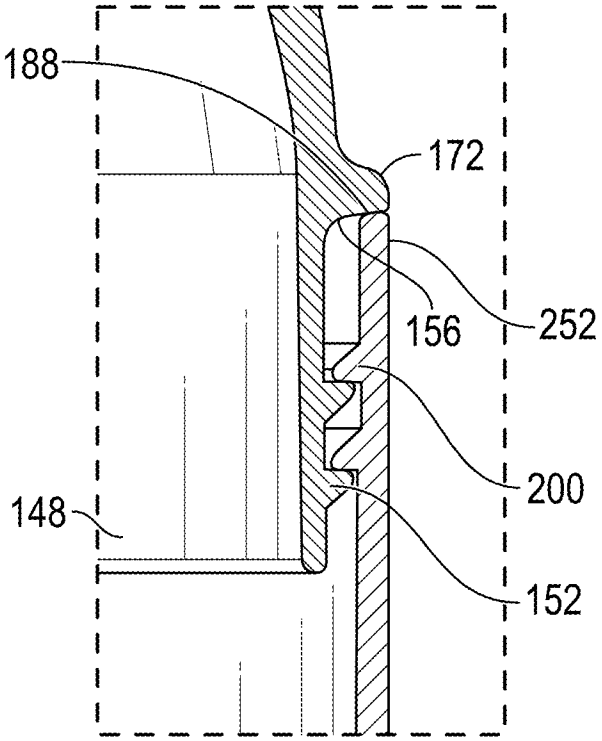
FIG. 13C shows an enlarged view of area XIIIC of FIG. 13A.
Figure 13B:
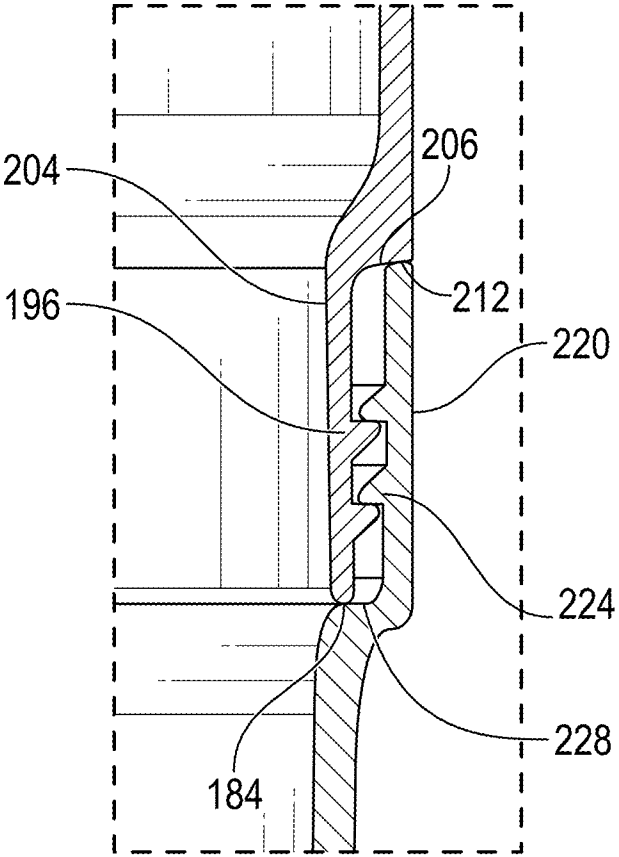
FIG. 13B shows an enlarged view of area XIIIB of FIG. 13A.

Further, as shown in FIG. 13C, with the lid shoulder 156 seated on the sleeve 116 at the second sleeve open end 188, the peripheral lip 172 extends to be radially flush with an outer perimeter 252 of the sleeve 116 at the second sleeve open end 188. This arrangement may further deprive an animal of easy access for prying or other detrimental engagement. Further, as also may be applicable for other engagements presented herein, the tactile response of the seating of modular bodies on corresponding shoulders during assembly can provide useful feedback to users to indicate fully-secured attachment.

Figure 14:
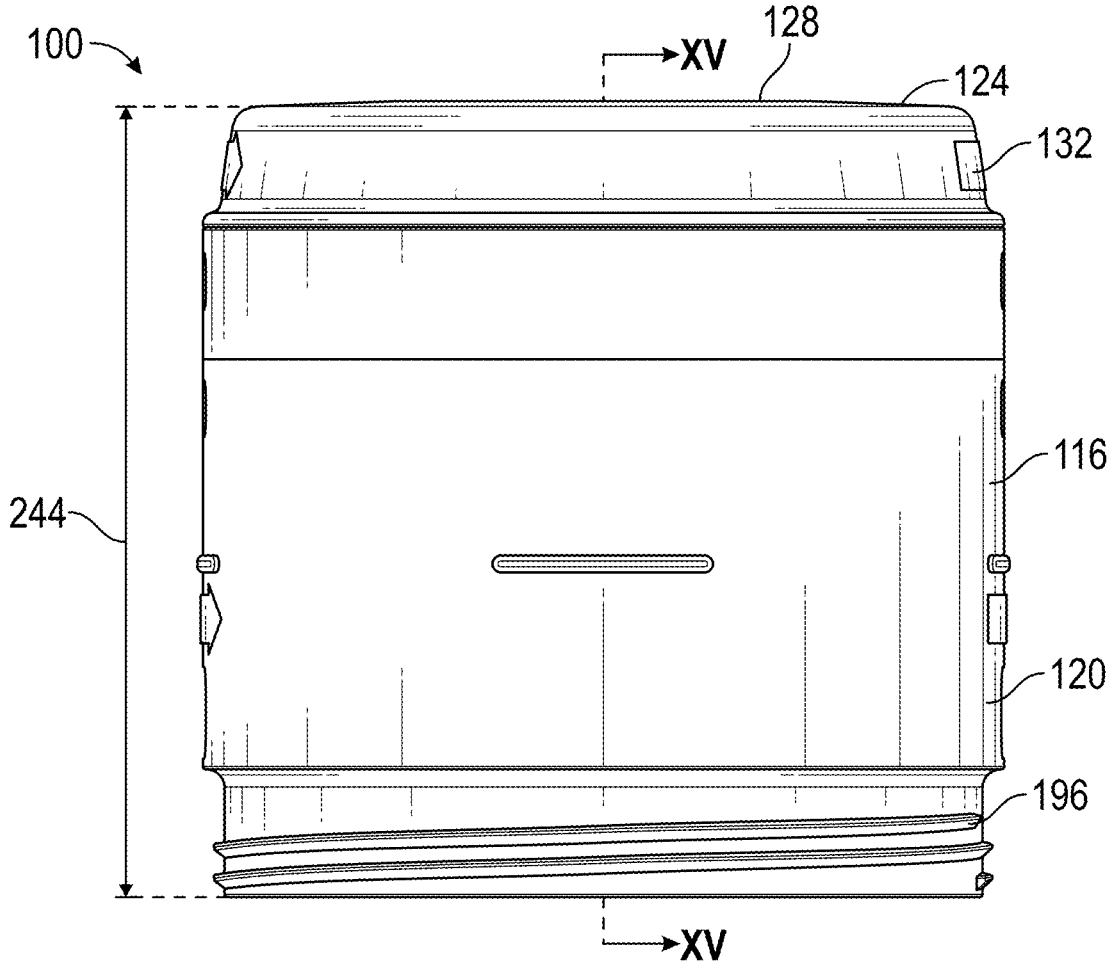
FIG. 14 is a front view of the bear-resistant container of FIG. 2.
Figure 15:
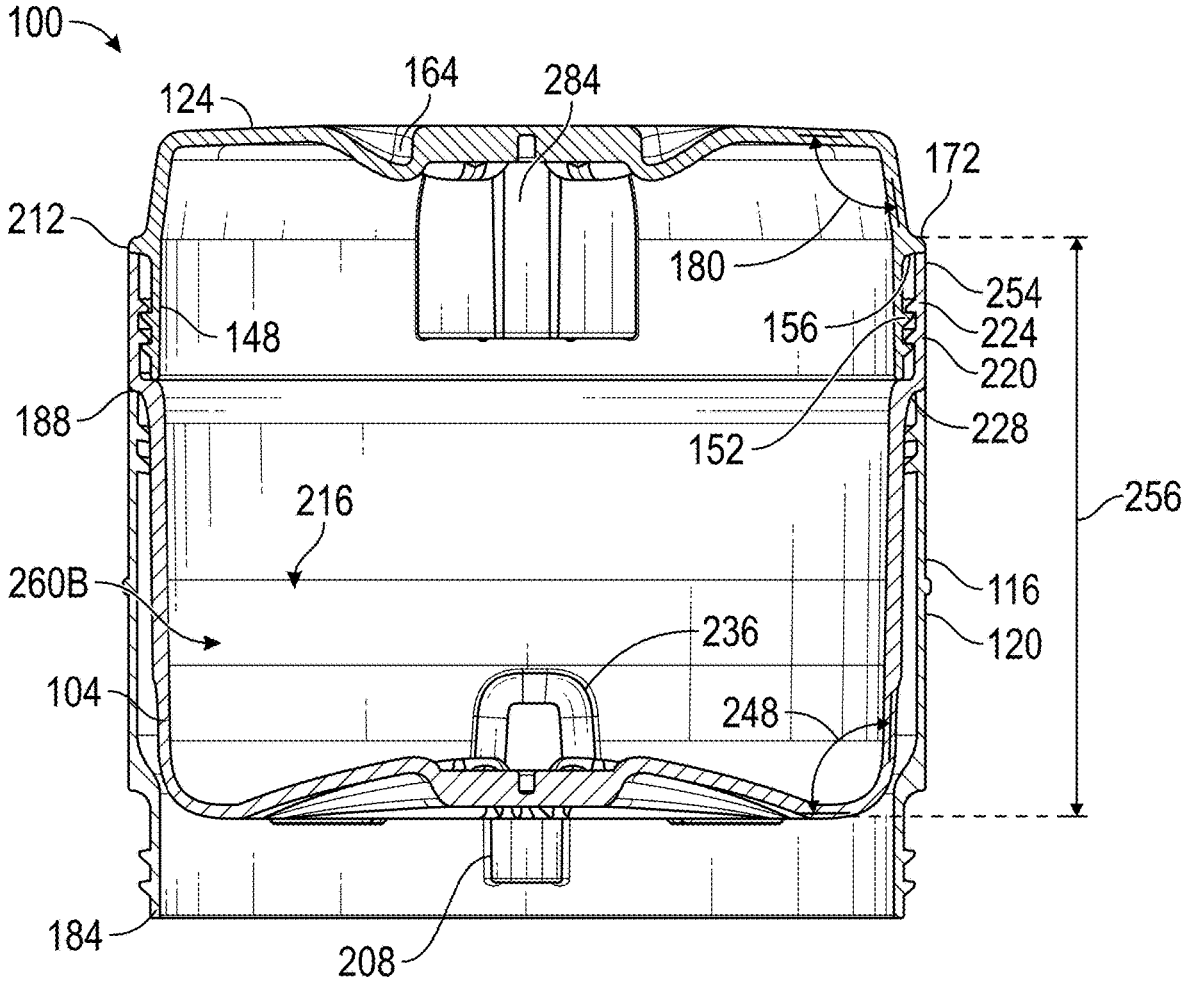
FIG. 15 is a cross-sectional view of the bear-resistant container of FIG. 14 taken along XV-XV.

In some compressed configurations, a base can be nested within a sleeve internal volume, to further reduce the collective footprint of the components of a bear-resistant container. Referring to FIGS. 14 and 15, for example, the base 104 is nested within the sleeve internal volume 192 defined by the sleeve side wall 120 that extends between the first sleeve open end 184 and the second sleeve open end 188. Correspondingly, as also shown in FIG. 13A, the base side wall 112 can taper inwardly from the base open end 212 toward the bottom wall 108 to facilitate easier nesting. The bear-resistant container 100 can be 25% shorter in the compressed (and nested) configuration than in the expanded configuration, for example, with about 80% of a height 256 of the base 104 being nested into the sleeve 116.

As shown in FIG. 15 in particular, in a compressed configuration, the lid external threads 152 are engaged with the base internal threads 224 to secure the lid 124 to the base 104 and close the base internal volume 216 at the base open end 212. Thus, engagement between the lid external threads 152 and the base internal threads 224 can reinforce a joint between the lid 124 and the base 104. In this regard, the lid 124 and the base 104 have similar geometry and benefits as discussed relative to threaded engagement of the lid 124 and of the sleeve 116, as shown in FIGS. 13A through 13C. For example, the lid end flange 148 axially overlaps to the interior of the base end flange 220 to provide reinforcement and protection against prying and lateral loading. Similarly, the lid shoulder 156 is seated on the base end flange 220 with the peripheral lip 172 aligned flush with an outer perimeter 254 of the base 104 at the base open end 212. Further, particular relative degrees of overlap as discussed above can also be beneficially provided.

As shown in the illustrated nested configuration, the base shoulder 228 is sized to seat on the sleeve 116 at the second sleeve open end 188. Thus, the second sleeve open end 188 can support the base 104 at the base shoulder 228 and provide a stable ring support for the (compressed) container 100 overall. Further, the exterior recess 236 of the base 104 can receive a housing 208 provided on the sleeve 116 for the latch system 137, for further reduction of overall footprint.

Thus, depending on the needs of a particular expedition, the bear-resistant container 100 can be selectively configured in the expanded or compressed configuration, so that material can be filled into the corresponding internal volume(s) of the utilized modular components (e.g., into the base internal volume 216 and the sleeve internal volume 192, or only into the base internal volume 216). The bear-resistant container 100 can then be closed with the lid 124 to selectively close a larger interior volume 260A (see FIG. 13A) or a smaller interior volume 260B (see FIG. 15) of the bear-resistant container 100 as a whole.

As also noted above, and referring now to FIGS. 18A-C, the latch system 137 includes the plurality of detents 140, which are configured to be sequentially actuated, with the lid 124 at different rotational orientations relative to the sleeve 116 (or the base 104), to allow sequentially rotation of the lid 124 to unscrew the lid 124 from a fully closed orientation. As noted above, for example, such operations can be guided by the indica 136 or otherwise, and can be similarly implemented for various other threaded engagement between container components (e.g., between the sleeve 116 and the base 104).

Figure 18A:
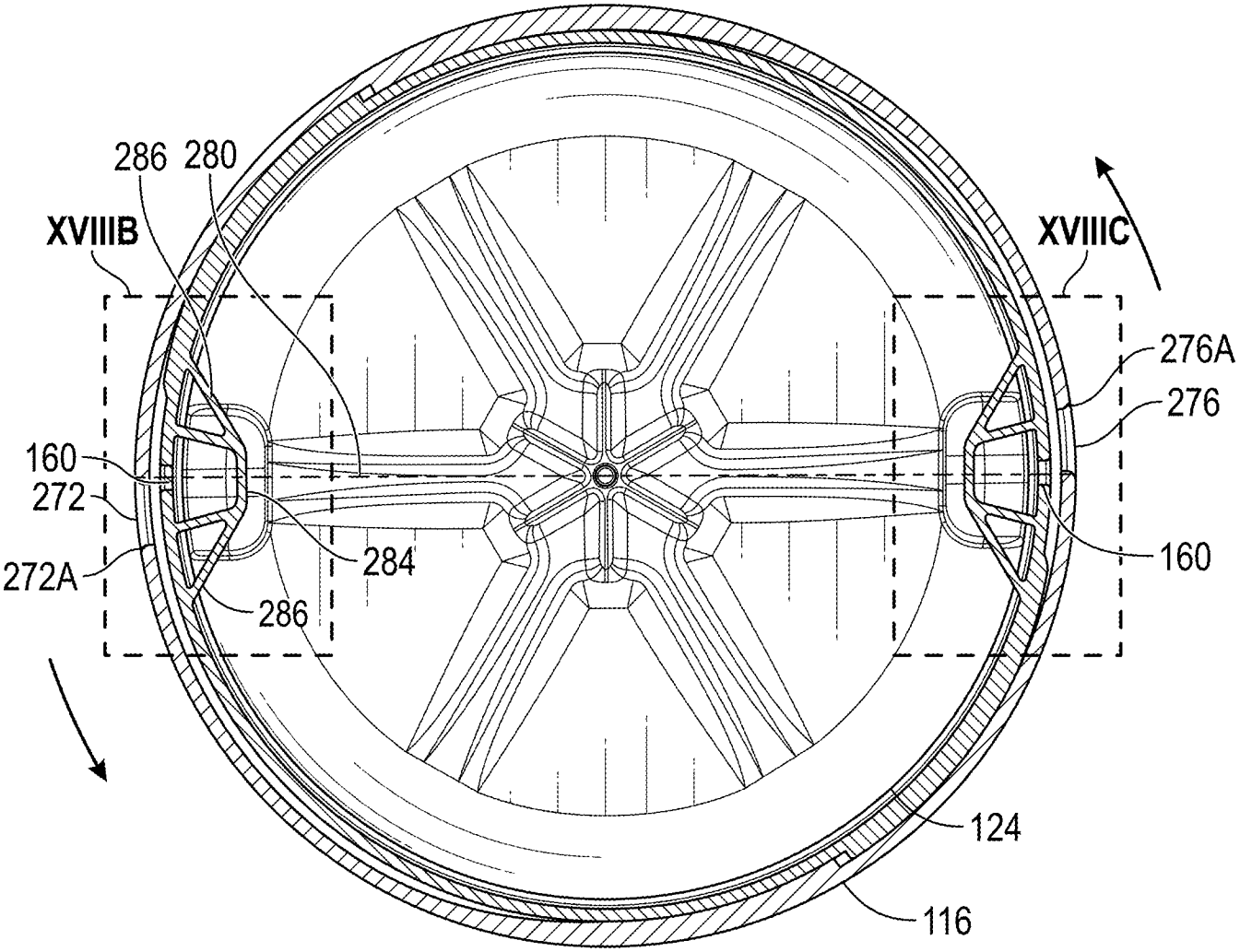
FIG. 18A is a cross-sectional view of the bear-resistant container of FIG. 12 taken along XVIII-XVIII.
Figure 18C:
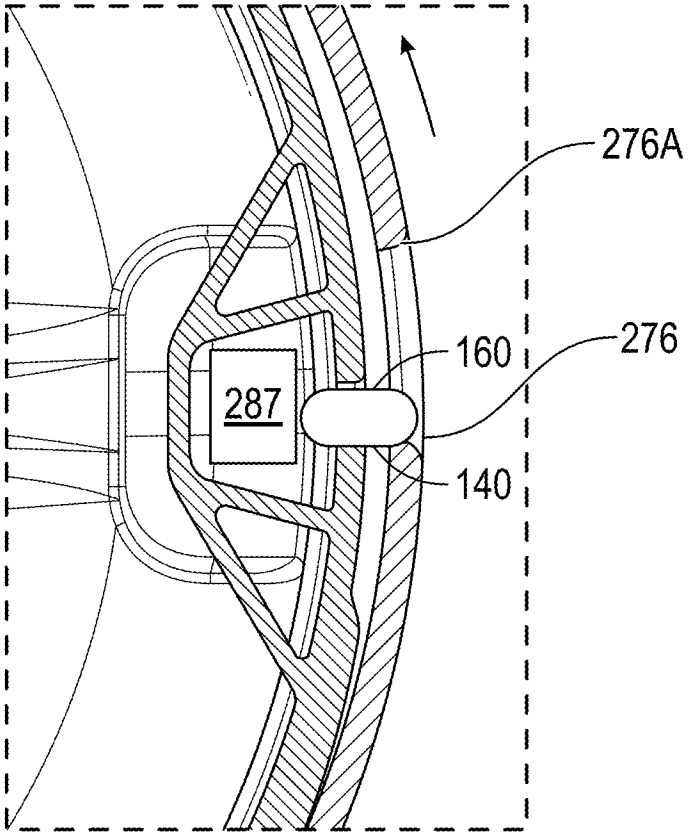
FIG. 18C shows an enlarged view of area XVIIIC of the cross-sectional view of FIG. 18A.
Figure 18B:
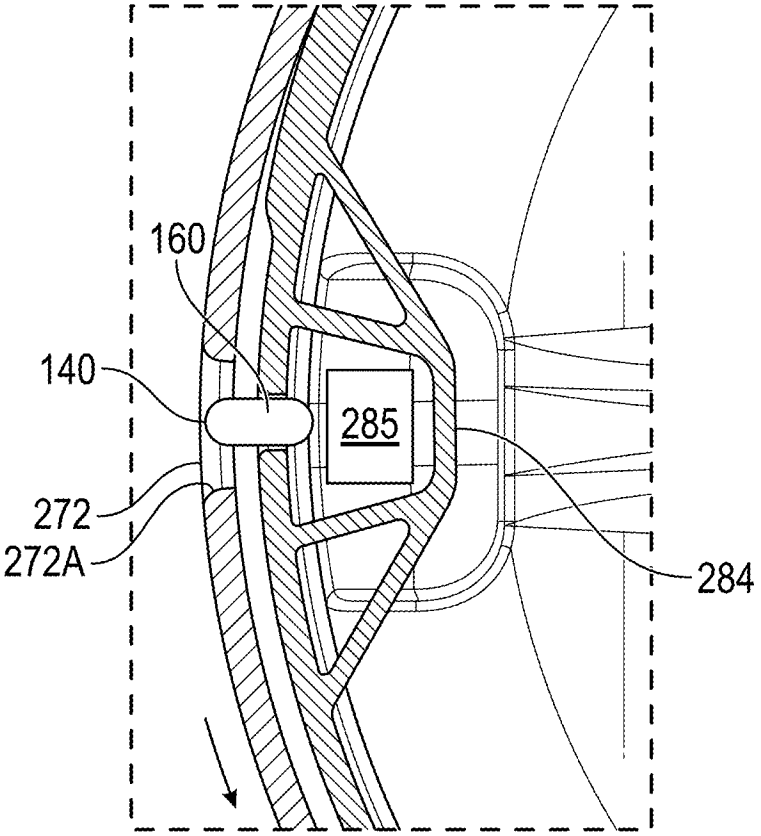
FIG. 18B shows an enlarged view of area XVIIIB of the cross-sectional view of FIG. 18A.

The detent openings 160 that receive corresponding detents (e.g., the detents 140, as shown in FIGS. 18B and 18C) exhibit an offset alignment relative to corresponding slots 272, 276. For example, as shown in FIG. 18A, the detent openings 160 are bisected by a diameter 280, whereas the first slot 272 and second slot 276 are (differently) offset relative to the diameter 280—e.g., with an end 276A of the slot 276 offset from the diameter 280 farther along a rotational direction of the lid 124 than is an end 272A of the slot 272, when the diameter 280 extends through the slot 272. Thus, as shown in FIGS. 18B and 18C, when the lid 124 is fully secured closed, a first of the detents 140 may protrude into the slot 272 (e.g., being biased outwardly by a spring or other biasing mechanism 285 of known design) and a second of the detents 140 may protrude into the slot 276 (e.g., being biased outwardly by a spring or other biasing mechanism 287 of known design). However, upon during rotation of the lid 124 as indicated by arrows in FIGS. 18A-18C, the first detent 140 will contact the end 272A of the slot 272 before the second detent 240 contacts the end 276A of the slot 276. Thus, the first detent 240 and the slot 272 may provide an initial stop on rotation of the lid 124, to block an attempted rotation of the lid 124 from a closed orientation toward an open orientation.

Correspondingly, a depression of the first detent 140 or other movement from locked to unlocked position may be needed, to move the first detent 140 clear of the end 272A of the slot 272 and then continue rotation of the lid 124 toward the open orientation. With continued rotation, however, the second detent 140 will then contact the end 276A of the slot 276, due to the offset alignment of the slots 272, 276 noted above. Thus, the second detent 140 and the slot 276 may provide a subsequent stop on rotation of the lid 124, at an intermediate orientation between the closed and open orientations, to block further rotation toward the open orientation. Accordingly, depression of the second detent 140 or other movement from locked to unlocked position may be needed—separately from the engagement with the first detent 140—to continue to rotate the lid 124 to be fully opened.

In other words, in a locked orientation within the first slot 272, the first detent 140 blocks rotation of the lid 124 relative to the sleeve 116 at a first rotational orientation of the lid 124 relative to the sleeve 116. In contrast, in an unlocked orientation the first detent 140 clears the end 272A of the slot 272 to permit the lid 124 to rotate relative to the sleeve 116, from the first rotational orientation toward an open orientation.

Similarly, in a locked orientation within the second slot 276, the second detent 140 blocks rotation of the lid 124 relative to the sleeve 116 at a second rotational orientation of the lid 124, relative to the sleeve 116, that is rotationally toward the open orientation relative to the first rotational orientation. In contrast, in an unlocked orientation, the second detent 268 clears the edge of the slot 276 to permit the lid 124 to rotate relative to the sleeve 116, from the second rotational orientation toward the open orientation.

Generally, this type of successive, deliberately timed engagement may be relatively easy for human operators, but relatively unlikely for wild animals. For example, as well as providing security against animal entry, operations with successive engagement of detents (e.g., buttons), and corresponding successive stages of rotation, may be significantly easier than simultaneous engagement of multiple detents in combination with corresponding rotation, particularly for larger-sized containers. Thus, a relatively easy but secure engagement can be provided overall. Further, in some cases, the latch system 137 can perform similarly relative to engagement between the sleeve 116 and the base 104, or between the lid 124 and the base 104.

Figure 17:
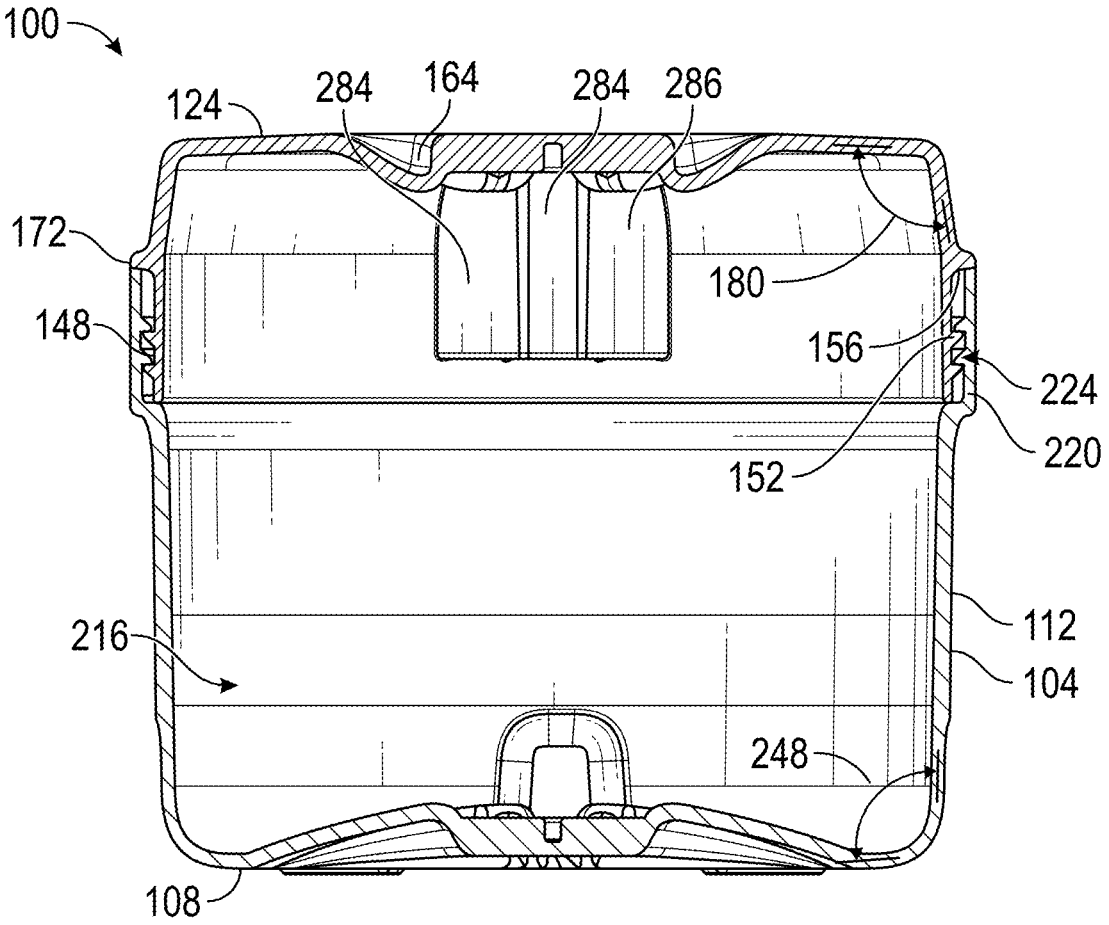
FIG. 17 is a cross-sectional view of the bear-resistant container of FIG. 16 taken along XVII-XVII.

In some examples, a latch system can include a latch housing that protrudes into an interior volume of a bear-resistant container. To provide improved operability, some examples, can include improved contours on such latch housings. Referring again to FIGS. 17 and 18A, for example, the latch system 137 includes a latch housing 284 that protrudes from the lid side wall 132 into the interior volume of the bear-resistant container 100. For example, the latch housing 284 can protect and define permitted movement of the detents 140 and the biasing mechanisms 285, 287 as shown in FIGS. 18B and 18C. Opposing sides of the latch housing 284, relative to the rotational direction of the lid 124, can define side walls 286 that taper toward the lid side wall 132. Thus, for example, the side walls 286 can help to deflect material that is within the base 104 away from the housing 284 during rotation of the lid 124, thereby reducing the potential for catching or binding. In some cases, the sleeve latch housing 208 (see, e.g., FIG. 13A) can be tapered similar to the latch housing 284 on the lid 124, although any impediment from the latch housing 284 to rotation of the sleeve 116 relative to the base 104 may be of relatively concern, particularly if the lid 124 can be reliably opened off of the sleeve 116 (e.g., as above) to address the issue.

Thus, examples of the disclosed technology can provide bear-resistant containers that can be flexibly adapted to a range of sizes, depending on the needs of a particular expedition or stage thereof. Further, as detailed above, some examples can include various structures for improved strength, durability, security, and ease of use.

As used herein, the use of "including," "comprising," or "having" and variations thereof is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Also as used herein, unless otherwise limited or defined, "or" indicates a non-exclusive list of components or operations that can be present in any variety of combinations, rather than an exclusive list of components that can be present only as alternatives to each other. For example, a list of "A, B, or C" indicates options of: A; B; C; A and B; A and C; B and C; and A, B, and C. Correspondingly, the term "or" as used herein is intended to indicate exclusive alternatives only when preceded by terms of exclusivity, such as "either," "one of," "only one of," or "exactly one of." For example, a list of "one of A, B, or C" indicates options of: A, but not B and C; B, but not A and C; and C, but not A and B. A list preceded by "one or more" (and variations thereon) and including "or" to separate listed elements indicates options of one or more of any or all of the listed elements. For example, the phrases "one or more of A, B, or C" and "at least one of A, B, or C" indicate options of: one or more A; one or more B; one or more C; one or more A and one or more B; one or more B and one or more C; one or more A and one or more C; and one or more of A, one or more of B, and one or more of C. Similarly, a list preceded by "a plurality of" (and variations thereon) and including "or" to separate listed elements indicates options of multiple instances of any or all of the listed elements. For example, the phrases "a plurality of A, B, or C" and "two or more of A, B, or C" indicate options of: A and B; B and C; A and C; and A, B, and C.

As used herein, unless otherwise defined or limited, "flush" indicates a deviation of a first surface from a second surface by either of 2 mm or, as applicable, 2% of a characteristic dimension of a container as measured perpendicular to the second surface (e.g., a diameter of a cylindrical container, relative to flush radially-outer surfaces).

As used herein in the context of threaded engagement, unless otherwise specified or limited, "axial" and derivatives thereof (e.g., "axially") refer to a direction defined by the relevant thread(s), corresponding to translational movement of the relevant threaded object by the threads in response to rotation. "Radial" and derivatives ("e.g., radially") are similarly used, in the context of threaded engagement, to indicate a direction along any radius of a circle corresponding to the relevant thread(s).

As also used herein, unless otherwise defined or limited, ordinal numbers are used herein for convenience of reference based generally on the order in which particular components are presented for the relevant part of the disclosure. In this regard, for example, designations such as "first," "second," etc., generally indicate only the order in which the relevant component is introduced for discussion and generally do not indicate or require a particular spatial arrangement, functional or structural primacy or order.

Also as used herein, unless otherwise limited or defined, "integral" and derivatives thereof (e.g., "integrally") describe elements that are manufactured as a single piece without fasteners, adhesive, or the like to secure separate components together. For example, an element stamped, cast, or otherwise molded as a single-piece component from a single piece of sheet metal or using a single mold, without rivets, screws, or adhesive to hold separately formed pieces together is an integral (and integrally formed) element. In contrast, an element formed from multiple pieces that are separately formed initially then later connected together, is not an integral (or integrally formed) element.

In some implementations, devices or systems disclosed herein can be utilized, manufactured, or installed using methods embodying aspects of the invention. Correspondingly, any description herein of particular features, capabilities, or intended purposes of a device or system is generally intended to include disclosure of a method of using such devices for the intended purposes, of a method of otherwise implementing such capabilities, of a method of manufacturing relevant components of such a device or system (or the device or system as a whole), and of a method of installing disclosed (or otherwise known) components to support such purposes or capabilities. Similarly, unless otherwise indicated or limited, discussion herein of any method of manufacturing or using for a particular device or system, including installing the device or system, is intended to inherently include disclosure, as embodiments of the invention, of the utilized features and implemented capabilities of such device or system.

The previous description of the disclosed embodiments is provided to enable any person skilled in the art to make or use the invention. Various modifications to these embodiments will be readily apparent to those skilled in the art, and the generic principles defined herein may be applied to other embodiments without departing from the spirit or scope of the invention. Thus, the invention is not intended to be limited to the embodiments shown herein but is to be accorded the widest scope consistent with the principles and novel features disclosed herein.

I claim:

1. A bear-resistant container comprising:

a base including a bottom wall and one or more base side walls that extend from the bottom wall to a base open end, to define a base internal volume and support base internal threads;

a sleeve including one or more sleeve side walls that extend between open ends of the sleeve, to define a sleeve internal volume and support sleeve external threads at a first sleeve open end and sleeve internal threads at a second sleeve open end; and a lid including a top wall and one or more lid side walls that extend from the top wall to support lid external threads;

in a compressed configuration of the bear-resistant container having a first height:

the base being nested within the sleeve internal volume; and the lid external threads being engaged with the base internal threads to secure the lid to the base and close the base internal volume at the base open end; and in an expanded configuration of the bear-resistant container having a second height larger than the first height:

the base internal threads being engaged with the sleeve external threads to secure the base to the sleeve, with the base internal volume open to the sleeve internal volume at the first sleeve open end; and the lid external threads being engaged with the sleeve internal threads to secure the lid to the sleeve and close the sleeve internal volume at the second sleeve open end.

2. The bear-resistant container of claim 1, wherein the base includes a base end flange that is offset radially outwardly at the base open end to support the base internal threads;

wherein the sleeve includes a sleeve end flange that is offset radially inwardly at the first sleeve open end to support the sleeve external threads; and wherein the base end flange axially overlaps with the sleeve end flange in the expanded configuration.

3. The bear-resistant container of claim 2, wherein the base end flange defines a base shoulder sized to seat on the sleeve, at the second sleeve open end, in the compressed configuration.

4. The bear-resistant container of claim 2, wherein the lid includes a lid end flange that supports the lid external threads; and wherein one or more of:

in the compressed configuration, the lid end flange axially overlaps with the base end flange; or in the expanded configuration, the lid end flange nests within the second sleeve open end.

5. The bear-resistant container of claim 4, wherein the one or more lid side walls define a lid shoulder disposed to one or more of:

seat on the base end flange in the compressed configuration; or seat on the sleeve, at the second sleeve open end, in the expanded configuration.

6. The bear-resistant container of claim 4, wherein the one or more lid side walls extend outwardly to a peripheral lip that is sized to sit flush with one or more of:

in the expanded configuration, an outer perimeter of the sleeve at the second sleeve open end; or in the compressed configuration, an outer perimeter of the base at the base open end.

7. The bear-resistant container of claim 1, wherein the top wall extends with a concave profile, relative to the sleeve internal volume, away from a bend between the top wall and the one or more lid side walls.

8. The bear-resistant container of claim 7, wherein the top wall extends away from the bend at an angle of greater than 90 degrees relative to the one or more lid side walls.

9. The bear-resistant container of claim 1, wherein the lid defines a maximum width and includes grip indents spaced radially inwardly from a bend by at least 15% of the maximum width.

10. The bear-resistant container of claim 1, further comprising a latch system that includes a plurality of detents configured to be sequentially moved, with the lid at different rotational orientations relative to the sleeve or the base, to sequentially release the lid to be unscrewed from a fully closed orientation.

11. The bear-resistant container of claim 10, wherein the latch system includes:

a first detent supported on the lid for movement between a first locked orientation and a first unlocked orientation;

a second detent supported on the lid for movement between a second locked orientation and a second unlocked orientation;

a first slot on the sleeve or the base that:

with the lid in a closed orientation, receives the first detent with the first detent in the first locked orientation;

with the first detent in the first locked orientation within the first slot, blocks rotation of the lid relative to the sleeve at a first rotational orientation of the lid relative to the sleeve or the base; and with the first detent in the first unlocked orientation, permits rotation of the lid relative to the sleeve or the base, from the first rotational orientation toward an open orientation; and a second slot on the sleeve or the base that:

with the lid in the fully closed orientation, receives the second detent with the second detent in the second locked orientation;

with the second detent in the second locked orientation within the second slot, blocks rotation of the lid relative to the sleeve at a second rotational orientation of the lid relative to the sleeve or the base, the second rotational orientation being rotationally toward the open orientation relative to the first rotational orientation; and with the second detent in the second unlocked orientation, permits rotation of the lid relative to the sleeve or the base, from the second rotational orientation toward the open orientation.

12. The bear-resistant container of claim 1, further comprising:

a latch system to secure the lid in a closed orientation relative to the sleeve or the base;

wherein the latch system including a latch housing that protrudes from the one or more lid side walls into an interior volume of the bear-resistant container; and wherein the latch housing includes side walls that taper toward the one or more lid side walls, on opposed sides of the latch housing relative to a rotational direction of the lid external threads.

13. The bear-resistant container of claim 1, further comprising:

a latch system to secure the sleeve in a closed orientation relative to the base, including a latch housing that protrudes from the one or more sleeve side walls into the sleeve internal volume; and wherein the one or more base side walls include an exterior recess that receives the latch housing in the compressed configuration.

14. The bear-resistant container of claim 1, wherein the one or more sleeve side walls taper inwardly from the base open end toward the bottom wall.

15. A method of configuring a bear-resistant container, the method comprising:

filling material into a base internal volume that is defined by a bottom wall of a base of the bear-resistant container and by one or more base side walls extending from the bottom wall to a base open end; and selectively closing an interior volume of the bear-resistant container in a compressed configuration or an expanded configuration;

wherein, in the compressed configuration:

the base is nested within a sleeve internal volume of a sleeve, defined by one or more sleeve side walls that extend between a first sleeve open end and a second sleeve open end; and external threads of a lid are engaged with internal threads of the base to secure the lid to the base and close the base internal volume; and wherein, in the expanded configuration:

the internal threads of the base are engaged with external threads of the sleeve to secure the base to the sleeve, with the base internal volume open to the sleeve internal volume at the first sleeve open end; and the external threads of the lid are engaged with internal threads of the sleeve to secure the lid to the sleeve and close the sleeve internal volume at the second sleeve open end.

16. The method of claim 15, further comprising, opening the interior volume of the bear-resistant container by:

engaging a first detent to release the lid for rotation from a closed orientation to an intermediate orientation; and engaging a second detent to release the lid for rotation from the intermediate orientation to an open orientation.

17. A bear-resistant container comprising:

a base including an integral base body that defines a base internal volume and a base open end with base threads;

a sleeve including an integral sleeve body that defines a sleeve internal volume, a first sleeve open end with first sleeve threads, and a second sleeve open end with second sleeve threads; and a lid including an integral lid body that includes lid threads;

the bear-resistant container being selectively configurable in:

a compressed configuration, in which the base is received into the sleeve internal volume and the lid threads engage the base threads to close the base open end; and an expanded configuration, in which the base threads engage the first sleeve threads to secure the base to the sleeve, with the base internal volume open to the sleeve internal volume at the first sleeve open end, and the lid threads engage the second sleeve threads to close the second sleeve open end.

18. The bear-resistant container of claim 17, wherein one or more of:

a bottom wall of the base extends inwardly from a side wall of the base at an angle of greater than 90 degrees; or a top wall of the lid extends inwardly from a side wall of the lid at an angle of greater than 90 degrees.

19. The bear-resistant container of claim 17, wherein the lid threads are formed on a lid flange that radially offset from an exterior shoulder; and wherein one or more of:

in the expanded configuration, the second sleeve open end extends axially past the lid threads to seat on the exterior shoulder; or in the compressed configuration, a base flange of the base that includes the base threads extends axially beyond the lid threads to seat on the exterior shoulder.

20. The bear-resistant container of claim 17, wherein the base threads are formed on a radially offset base flange; and wherein one or more of:

the lid threads are formed on a lid flange and, in the compressed configuration, the lid flange and the base flange overlap, axially beyond the engagement of the lid thread and the base thread, to reinforce a joint between the lid and the base; or the first sleeve threads are formed on a first radially offset sleeve flange and, in the expanded configuration, the first radially offset sleeve flange and the base flange overlap axially beyond the engagement of the sleeve thread and the base thread, to reinforce a joint between the sleeve and the base.

* * * * *